US009073201B1

(12) United States Patent
Foley et al.

(10) Patent No.: US 9,073,201 B1
(45) Date of Patent: Jul. 7, 2015

(54) UNDER HOOD SERVICE TRAY

(75) Inventors: Patrick Foley, Southhaven, MS (US); Richard Heidelberger, Mauldin, SC (US); Michael Staples, Mauldin, SC (US)

(73) Assignee: KKU, INC., Tokyo (JP)

( * ) Notice: Subject to any disclaimer, the term of this patent is extended or adjusted under 35 U.S.C. 154(b) by 456 days.

(21) Appl. No.: 13/400,401

(22) Filed: Feb. 20, 2012

Related U.S. Application Data

(63) Continuation-in-part of application No. 12/584,391, filed on Sep. 4, 2009.

(51) Int. Cl.
*B25H 5/00* (2006.01)

(52) U.S. Cl.
CPC ..... *B25H 5/00* (2013.01)

(58) Field of Classification Search
CPC ..... B25H 3/00; B25H 3/06; B25H 1/16; B25H 1/12; B25H 1/18; B25H 5/00; B60R 11/06
USPC ..... 211/133.3, 85.8, 133.1; 108/25, 27, 44, 108/147, 146, 147.19, 147.21; 248/125.9, 248/125.8, 129; 280/32.6, 47.34, 47.35, 280/79.11, 79.3, 638, 35; 254/2 B, 7 R, 98
See application file for complete search history.

(56) References Cited

U.S. PATENT DOCUMENTS

| | | | | |
|---|---|---|---|---|
| 1,660,521 | A | | 2/1928 | Nordgren |
| 1,833,829 | A | | 11/1931 | Doolin |
| 1,867,763 | A | | 7/1932 | Rose |
| 2,628,147 | A | * | 2/1953 | Berner ..... 312/246 |
| 2,701,168 | A | | 2/1955 | Schemers |
| 2,805,778 | A | | 9/1957 | Yordi |
| 2,872,252 | A | * | 2/1959 | Konkle ..... 182/131 |
| 2,925,917 | A | | 2/1960 | Kammeyer |
| 2,962,333 | A | | 11/1960 | Policastro |
| 3,107,636 | A | * | 10/1963 | Knight ..... 108/102 |
| 3,854,428 | A | * | 12/1974 | Fullenkamp ..... 108/146 |
| 4,401,036 | A | * | 8/1983 | Russo et al. ..... 108/146 |
| 4,488,497 | A | * | 12/1984 | Bevans ..... 108/147.21 |
| 4,715,573 | A | | 12/1987 | Liegel |
| 4,880,248 | A | * | 11/1989 | Elmer ..... 280/47.35 |
| 5,080,381 | A | * | 1/1992 | Perez ..... 280/35 |
| 5,108,118 | A | | 4/1992 | Schaevitz |
| 5,149,114 | A | | 9/1992 | Lewandowskie et al. |
| 5,165,632 | A | | 11/1992 | Kuan |
| 5,181,681 | A | * | 1/1993 | Edwards ..... 248/125.1 |
| 5,330,209 | A | | 7/1994 | Pool |
| 5,374,019 | A | * | 12/1994 | Fischer ..... 248/125.7 |
| 5,375,862 | A | * | 12/1994 | Sirianno ..... 280/79.5 |
| 5,460,392 | A | * | 10/1995 | Hansen ..... 280/32.6 |
| 5,511,674 | A | | 4/1996 | Boyd et al. |
| 5,785,329 | A | * | 7/1998 | Stanley ..... 280/79.5 |
| 5,971,512 | A | | 10/1999 | Swan |
| 6,240,856 | B1 | * | 6/2001 | Paskey et al. ..... 108/146 |

(Continued)

*Primary Examiner* — Patrick Hawn
(74) *Attorney, Agent, or Firm* — Bennett Mullinax LLC

(57) ABSTRACT

An under hood service tray is provided that includes a base with a pair of longitudinally extending legs that are spaced from one another in a lateral direction and that engage a laterally extending leg. The base has an end leg located on a closed first end of the base. The end leg has a first portion that has a component that extends in the lateral direction, and a second portion that has a component that extends in a longitudinal direction. The under hood service tray also has a vertical member attached to the base, and a tray attached to the vertical member.

11 Claims, 16 Drawing Sheets

(56) References Cited

U.S. PATENT DOCUMENTS

| | | | | |
|---|---|---|---|---|
| 6,688,634 | B2 * | 2/2004 | Noffsinger | 280/651 |
| 6,910,429 | B1 | 6/2005 | Matay et al. | |
| 7,341,006 | B2 * | 3/2008 | Hernandez | 108/115 |
| 7,490,837 | B2 * | 2/2009 | Pond et al. | 280/47.35 |
| 2003/0062700 | A1 | 4/2003 | Stallbaumer | |
| 2005/0098967 | A1 | 5/2005 | Hernandez | |
| 2005/0161894 | A1 | 7/2005 | Lensing | |
| 2005/0204967 | A1 * | 9/2005 | Wrinkle | 108/146 |
| 2006/0170170 | A1 | 8/2006 | Whiteside et al. | |

* cited by examiner

UNDER HOOD SERVICE TRAY

FIELD OF THE INVENTION

The present invention relates generally to an under hood service tray used for holding mechanics tools during work on an automobile. More particularly, the present application involves an under hood service tray capable of being positioned at locations convenient for a mechanic during work under a raised hood of the automobile.

BACKGROUND

Work on an automobile requires the use of a variety of different mechanic tools. A service garage may maintain tools in a storage location thus forcing the mechanic to travel from a working location of the automobile to the storage location in order to retrieve the necessary tools. This task consumes both time and labor of the mechanic and thus reduces efficiency of the servicing procedure and leads to increased costs. It is therefore the case that tool trays are sometimes used to hold necessary tools at a more convenient location for the mechanic next to the work area to save labor and time.

One such tool tray includes a bracket on the bottom that is capable of being mounted onto the neck of an automobile radiator. The mechanic removes the radiator cap, fastens the bracket to the exposed neck which positions the tool tray at a location convenient for the mechanic when working under the hood of the automobile. Other such tool trays are adapted to be attached to a tie plate hood element located between the grille and radiator of the automobile. Once attached, the tool tray holds mechanics tools at a location that is convenient for the mechanic during a repair or servicing procedure. Although suitable for their intended purposes, such tool trays are difficult to carry from one location to the next, require labor and time to effect attachment of the tool tray to the vehicle, and may not be capable of being connected to different makes and models of vehicles.

Another such tool tray includes a tray that can be attached to and removed from a vertical support member that is affixed to a base. The tray can hold mechanics tools and can be removed from the vertical support member and placed onto the same surface as the automobile. The tray includes a number of castors thereon so that a mechanic working under the automobile can position the tray next to himself or herself to easily access the tools. Alternatively, when the vehicle is elevated by a hydraulic lift the tray can be reattached to the vertical support member which can be adjusted to the necessary height. The mechanics tools in the tray are then likewise located at a convenient position for access by the mechanic. Although capable of working for its intended purpose, such a tool tray due to its design cannot be positioned at various locations with respect to the automobile for ease of access when the mechanic is standing on the ground and working under the hood of the automobile. As such, there remains room for variation and improvement in the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
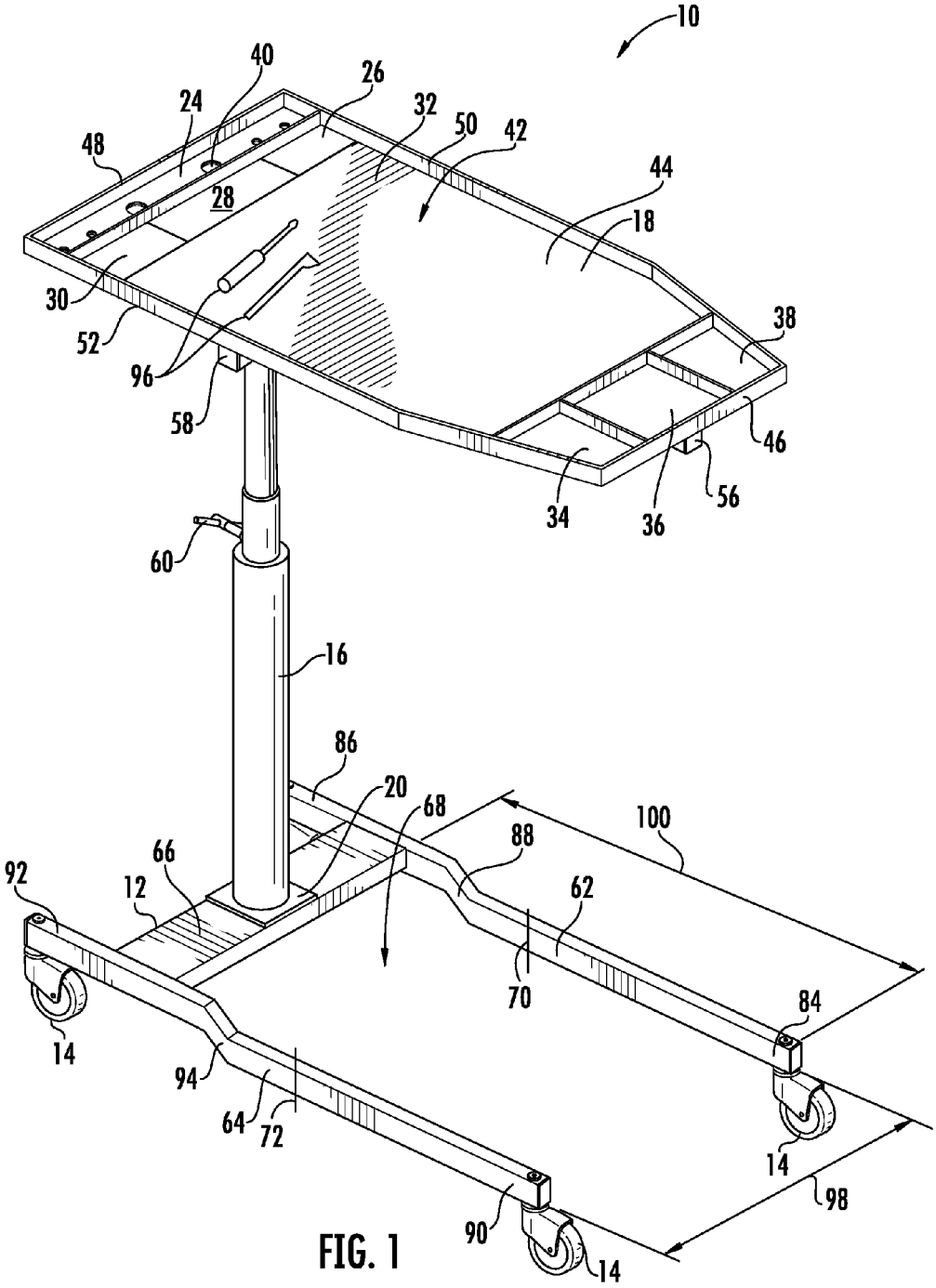
FIG. 1 is a perspective view of an under hood service tray in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an under hood service tray 10 used for holding mechanic tools 96 during servicing or repair of components in an engine compartment 80 of an automobile 76 by a mechanic. A tray 18 is included that is capable of holding a plurality of mechanic tools 96 and is supported by a vertical member 16. The tray 18 is not capable of being removed from the vertical member 16 and the height of the vertical member 16 can be adjusted so as to adjust the height of the tray 18. A base 12 that features a plurality of castors 14 that render the base mobile supports the vertical member 16. The base 12 is configured to define an opening 68 into which a tire 74 of the automobile 76 can be positioned. In this manner, the under hood service tray 10 can be more conveniently located with respect to the engine compartment 80 to hold mechanic tools 96 in a location for the mechanic so as to reduce labor and time necessary in performing the desired servicing or repair.

FIG. 1 illustrates an under hood service tray 10 in accordance with one exemplary embodiment. The under hood service tray 10 includes a vertical member 16 attached to both a base 12 and a tray 18. A plurality of mechanic tools 96, such as a wrench and a screw driver, can be retained on the tray 18 and thus presented for access to the mechanic. The tray 18 includes a front wall 46 and a rear wall 48 that are parallel to one another. A pair of side walls 50 and 52 extend between the front and rear walls 46 and 48. A portion of the side walls 50 and 52 are parallel to one another, and a portion of the pair of side walls 50 and 52 are not parallel to one another. In this regard, the side walls 50 and 52 angle in towards one another in the direction towards the front wall 46. The front of the tray 18 is thus angled and has a smaller length in the lateral direction than the rest of the tray 18. This arrangement may allow the tray 18 to be more conveniently located with respect to the automobile 76 since the smaller width of the tray 18 at the front can be more easily located within areas of the automobile 76 such as under the hood 78. The front of the tray 18 may be the portion of the tray 18 that is located furthest under the hood 78 during use.

Figure 3:
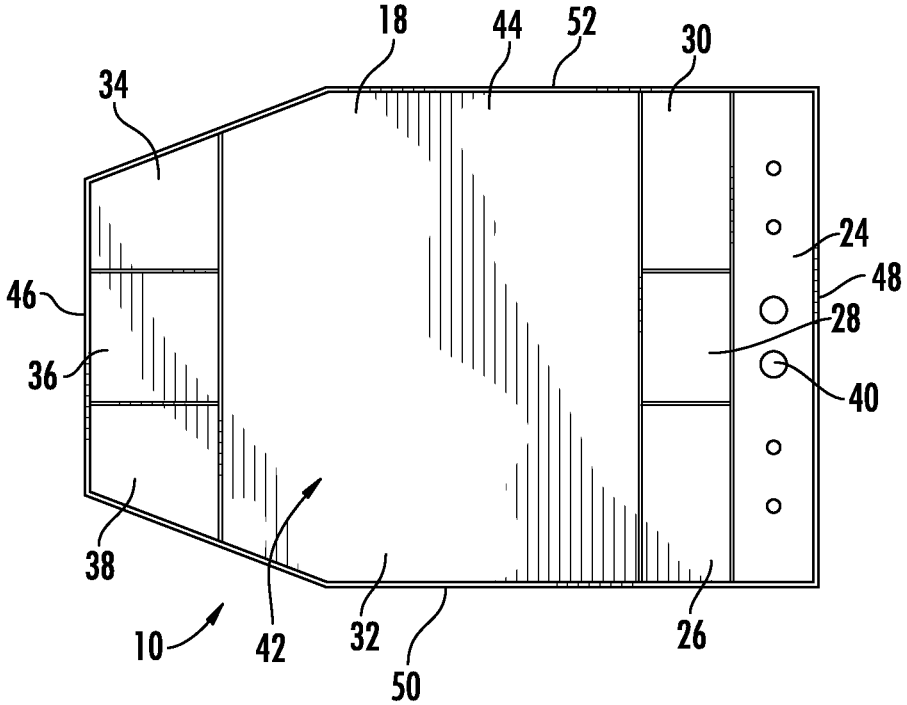
FIG. 3 is a top view of the under hood service tray of FIG. 1.
Figure 4:
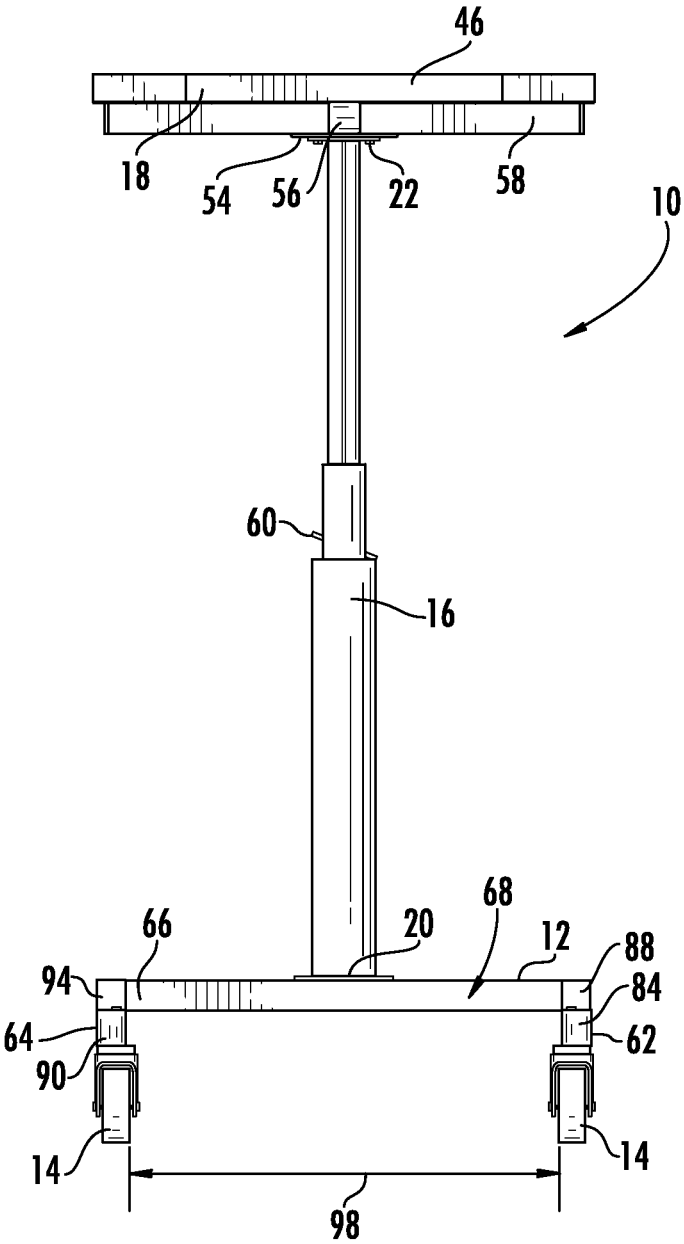
FIG. 4 is front view of the under hood service tray of FIG. 1.

With reference now to both FIGS. 1 and 3, a plurality of open compartments are formed on the upper surface 42 of the tray 18. The compartments can be used to organize and hold different types of mechanic tools 96 that are used to accomplish different tasks with respect to the servicing and repair of the automobile 76. Eight open compartments 24, 26, 28, 30, 32, 34, 36 and 38 are defined on the upper surface 42 by the walls 46, 48, 50 and 52 and interior walls of the tray 18. However, it is to be understood that any number of compartments can be defined in the tray 18 in accordance with various exemplary embodiments. For example, from one to fifteen compartments may be defined in the tray 18 in accordance with other exemplary embodiments.

Slip resistant material 44 can be included on the upper surface 42 in order to inhibit the sliding or movement of mechanic tools 96 located on the tray 18. The slip resistant material 44 may be a material that has a higher coefficient of friction than other portions of the tray 18 such as the walls 46, 48, 50 or 52. In this regard, the slip resistant material 44 may be made of a material such as rubber or plastic while other portions of the tray 18 are made of a metal such as steel or aluminum. As shown, the slip resistant material 44 is located within compartments 26, 28, 30, 32, 34, 36 and 38 and is not located within compartment 24. However, the slip resistant material 44 may be located within all or none of the compartments of the tray 18 in accordance with different exemplary embodiments. Additionally, the slip resistant material 44 may be located on the outside surfaces of the tray 18 such as on the outside surfaces of the walls 46, 48, 50 and 52. Placement of the slip resistant material 44 at these locations of the tray 18 may act as a guard against marring or scratching of the automobile 76 that would otherwise occur upon contact of the automobile 76 by harder or sharper portions of the tray 18.

The compartments may be provided so that compartment 32 that is located in the middle of the tray 18 is the largest compartment. Three smaller compartments 26, 28 and 30 may be located rearward of compartment 32 for the storage of smaller mechanic tools 96, and three smaller compartments 34, 36 and 38 may be located forward of compartment 32 for holding smaller mechanic tools 96. However, it is to be understood that the compartments can be variously sized and configured in accordance with other exemplary embodiments.

A plurality of apertures 40 are disposed through the tray 18 and are located in compartment 24. The apertures 40 can be used to hold various mechanic tools 96 such as pneumatic wrenches or drills. The apertures 40 may be located at the compartment 24 proximate to the rear wall 48 so that cords extending from mechanic tools 96 located in the apertures 40 are less likely to interfere with servicing or repair of the automobile 76 since they are located more remote from the automobile 76 during use of the tray 10. Although shown as being generally flat in shape, the upper surface 42 may include recesses or other features in accordance with other exemplary embodiments that may function to more securely hold mechanic tools 96 as desired. The upper surface 42 of tray 10 can be located a distance from 3 feet to 6 feet, from 3 feet to 4 feet, from 4 feet to 5 feet, from 5 feet to 6 feet, or from 2 feet to 4 feet from the base 12 or the surface 82 onto which the tray 10 rests. In other embodiments, the upper surface 41 may be located up to 4 feet, up to 5 feet, or up to 6 feet from the base 12 or the surface 82 onto which the tray 10 rests.

Figure 2:
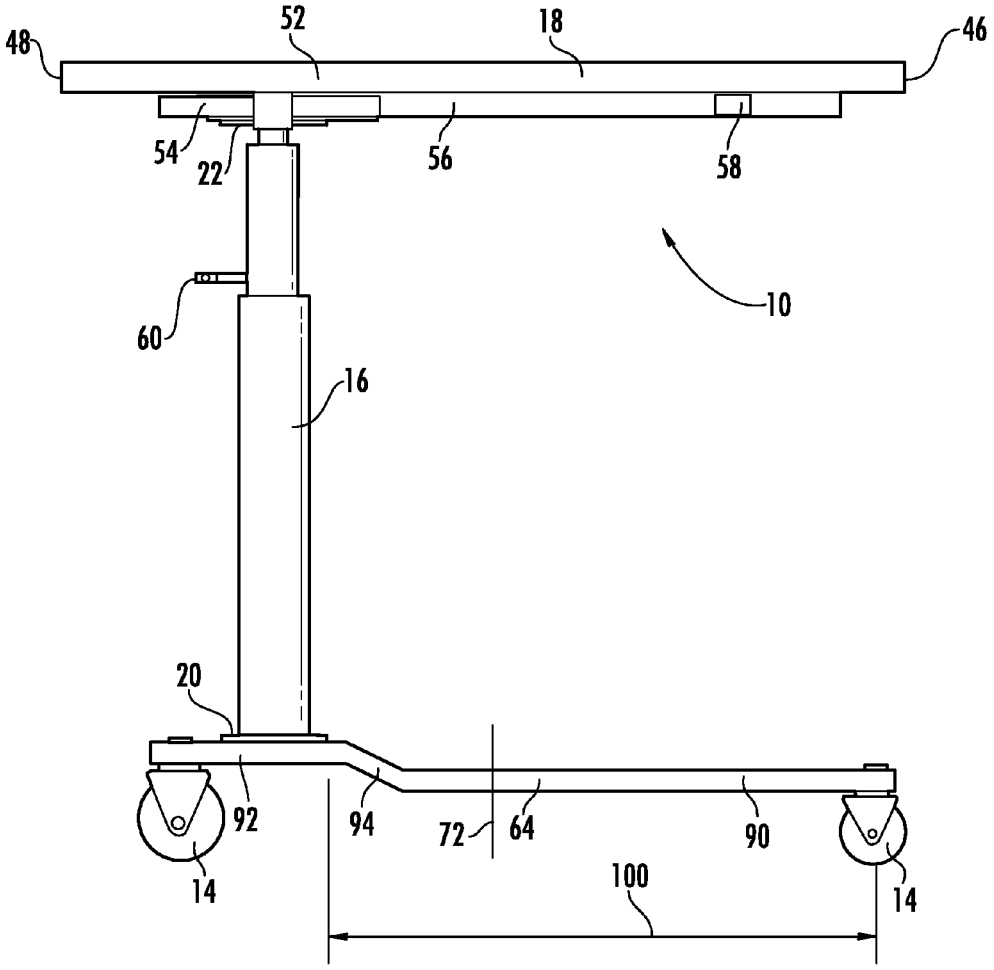
FIG. 2 is a side view of the under hood service tray of FIG. 1.
Figure 5:
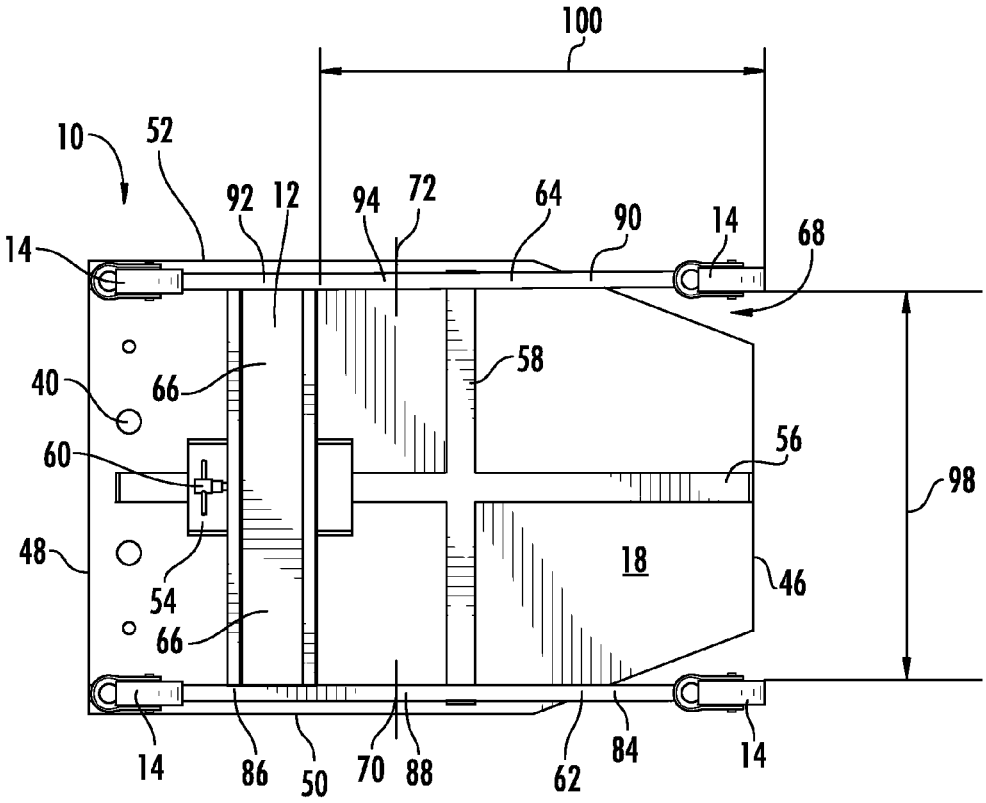
FIG. 5 is a bottom view of the under hood service tray of FIG. 1.

The tray 18 includes a pair of reinforcing members 56 and 58 that can be more easily seen with reference to FIGS. 2 and 5. The reinforcing members 56 and 58 function to strengthen the tray 18 and may have a cross-section that is square tubular in shape in accordance with one exemplary embodiment. Longitudinally extending reinforcing member 56 is located at the lateral midpoint of the tray 18 and extends in the longitudinal direction under the upper surface 42. Laterally extending reinforcing member 58 is also located under the upper surface 42 and extends in the lateral direction of the tray 18 and intersects the longitudinally extending reinforcing member 56. Tray 18 also includes a mounting bracket 54 that has a generally open channel shape. The mounting bracket 54 may be located so that a portion of the length of the longitudinally extending reinforcing member 56 is located within the channel formed by the mounting bracket 54. The mounting bracket 54 may be located at the lateral midpoint of the tray 18 and an end 22 of the vertical member 16 may be attached thereon. End 22 can be bolted, welded or otherwise attached to the mounting bracket 54 in such a manner that the tray 18 is not removable from the vertical member 16. Further, the connection can be effected so that the tray 18 is not capable of being rotated with respect to the vertical member 16 or the base 12. In accordance with certain exemplary embodiments, the vertical member 16 and the tray 18 may be an integral piece such that they are attached to one another in this regard.

The vertical member 16 may be a fixed member so that its height is not capable of being adjusted. In accordance with other exemplary embodiments, the vertical member 16 may be capable of being adjusted so that its height, and consequently the height of the tray 16, can be varied as desired. Modification of the height of the vertical member 16 may allow the tray 18 to be located at a height that is more convenient for the mechanic. The vertical member 16 may be a telescoping member such that portions of the vertical member 16 nest within one another. The user may pull the innermost portion of the vertical member 16 upwards or downwards to a desired location, and a retaining pin 60 can be inserted therethrough in order to fix the height of the vertical member 16. The user can subsequently remove the retaining pin 60 should a readjustment of the height of the vertical member 16 be desired. The vertical member 16 may be arranged in a variety of manners so as to be rendered adjustable in the vertical direction. In accordance with one exemplary embodiment, the vertical member 16 may have a crank mechanism that can be actuated by the user so as to effect raising and lowering of the vertical member 16. In yet other exemplary embodiments, the vertical member 16 may include a hydraulic component that can be actuated by the user so as to effect an adjustment in the vertical direction.

The base 12 of the under hood service tray 10 is shown with reference to FIGS. 1 and 5. The base 12 includes a longitudinally extending leg 62 and a longitudinally extending leg 64. A laterally extending leg 66 is located between and is attached to both of the longitudinally extending legs 62 and 64. An end 20 of the vertical member 16 is attached to the lateral midpoint of the laterally extending leg 66. The attachment between end 20 and the laterally extending leg 66 may effected through welding, bolts or other mechanical fasteners such that the resulting connection is not capable of being removed. Further, in accordance with certain exemplary embodiments the connection between end 20 and laterally extending leg 66 may be made so that the vertical member 16 is not capable of being rotated with respect to the laterally extending leg 66. Laterally extending leg 66 can be generally channel shaped such that the open portion of the channel faces downwards. The laterally extending leg 66 may be a single integral piece in certain exemplary embodiments and may be made of steel or aluminum.

The laterally extending leg 66 can be positioned in the base 12 so that it is not located at the longitudinal midpoint 70 of the longitudinally extending leg 62 or at the longitudinal midpoint 72 of the longitudinally extending leg 64. In this regard, the laterally extending leg 66 is located towards the rearward ends of the longitudinally extending legs 62 and 64. Laterally extending leg 66 can be attached to longitudinally extending legs 62 and 64 by way of bolts, screws, various mechanical fasteners or welding. In further exemplary embodiments, the laterally extending leg 66 may be integrally formed with the longitudinally extending legs 62 and 64. The base 12 may be arranged so that up to 25% of the length of the longitudinally extending legs 62 and 64 is located on one side of the laterally extending leg 66. In accordance with other exemplary embodiments, up to 5%, up to 10%, up to 15%, or up to 20% of the length of the longitudinally extending legs 62 and 64 may be located on one side of the laterally extending leg 66. The longitudinally extending legs 62 and 64 in addition to the laterally extending leg 66 may define an opening 68 on one end of the base 12. Opening 68 has an open front end and may not include material within the perimeter defined by the longitudinally extending legs 62 and 64 and the laterally extending leg 66 up to the tray 18. The opening 68 may have a width 98 of 12 inches in accordance with one exemplary embodiment. In accordance with other exemplary embodiments, the width 98 may be from 6 inches to 10 inches, from 10 inches to 15 inches, from 15 inches to 20 inches, or up to 36 inches. Opening 68 may have a length 100 that is 24 inches. In accordance with other exemplary embodiments, length 100 may be from 12 inches to 18 inches, from 18 inches to 24 inches, from 24 inches to 36 inches, or up to 48 inches. It is to be understood, however, that the disclosed widths 98 and lengths 100 are only exemplary and that others are possible in accordance with other exemplary embodiments of the under hood service tray 10.

With reference now to FIGS. 1 and 2, longitudinally extending leg 62 includes a first portion 84 connected to a second portion 86 by way of an intermediate portion 88. The first portion 84 is located at a height that is less than the height of the second portion 86. As such, the second portion 86 is located generally closer to the tray 18 than the first portion 84. The intermediate portion 88 connects the two portions 84 and 86 and extends at an angle to both the longitudinal and vertical directions. The laterally extending leg 66 is attached to the second portion 86 and is located generally above the first portion 84. The longitudinally extending leg 62 can be a single integral piece or may be made of multiple components in accordance with different exemplary embodiments that are welded or otherwise attached to one another. Longitudinally extending leg 62 may be made out of steel or aluminum in accordance with certain exemplary embodiments. Portions 84, 86 and 88 may have a square tubular cross-sectional shape that are of the same size in accordance with certain exemplary embodiments. In yet other embodiments, the cross-sectional shape of the second portion 86 may be larger than the cross-sectional shape of the first portion 84.

Longitudinally extending leg 64 may be provided with a first portion 90, second portion 92, and an intermediate portion 94 that functions to connect the first portion 90 and second portion 92. The portions 90, 92 and 94 in addition to the longitudinally extending leg 64 may be arranged and provided in a manner similar to those disclosed with respect to portions 84, 86 and 88 and leg 62 as discussed above and a repeat of this information is not necessary.

The second portions 86 and 92 may be located at a height above that of the first portions 84 and 90 to effect a design of base 12 that is stronger towards the rear end thereof due to the positioning of the vertical member 16 and tray 18 thereto. The intermediate portions 88 and 94 are angled downwards from the second portions 86 and 92 to further strengthen the base 12 as a stronger load bearing portion of the base is located on one side of the intermediate portions 88 and 94.

Castors 14 are provided on base 12 and are attached to the longitudinally extending legs 62 and 64. A pair of castors 14 are located proximate to opposite ends of the longitudinally extending leg 62, and a pair of castors 14 are located proximate to the opposite ends of the longitudinally extending leg 64. The sizes of the castors 14 and their load bearing rating need not be identical. Elevation of the second portions 86 and 92 above the first portions 84 and 90 dictate that the circumference of the castors 14 attached to the second portions 86 and 92 be larger than the circumference of castors 14 attached to the first portions 84 and 90. The load bearing capacity of the castors 14 attached to the second portions 86 and 92 may be greater than that of those attached to the first portions 84 and 90 as these castors 14 are more closely positioned to the vertical member 16 and may hold more of the weight of the vertical member 16, tray 18 and carried mechanic tools 96. However, it is to be understood that in other exemplary embodiments the load bearing capacity and the size of all of the castors 14 of the under hood service tray 10 may be identical.

Figure 6:
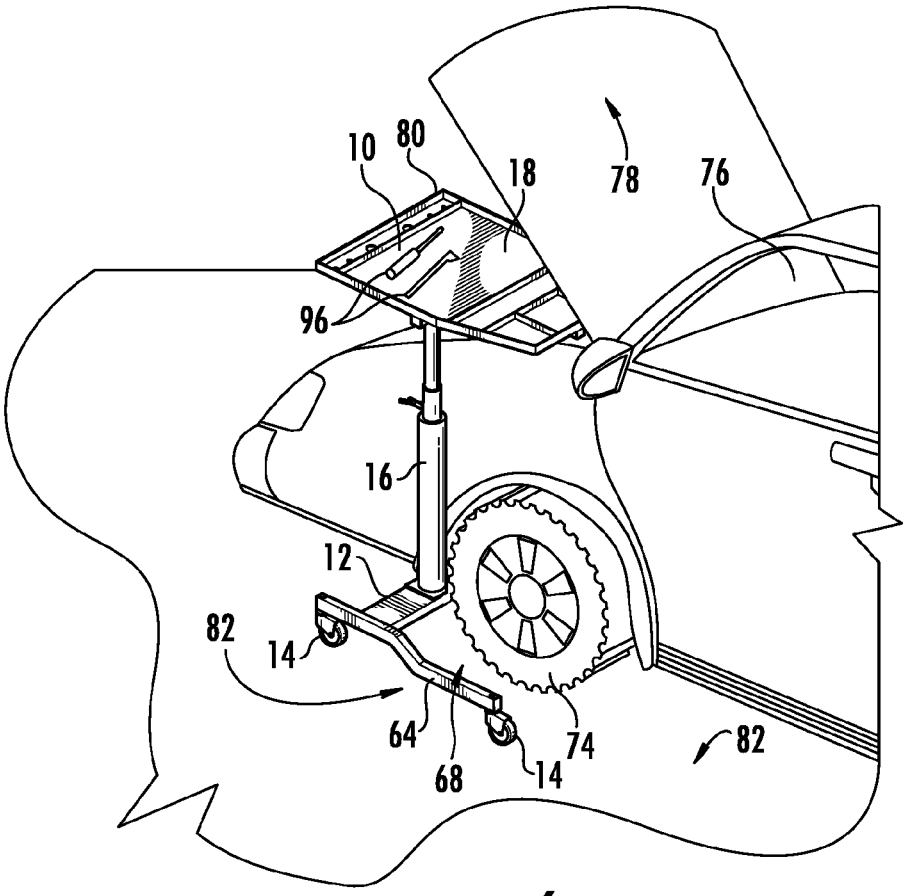
FIG. 6 is a perspective view of the under hood service tray of FIG. 1 placed next to an automobile for use by a mechanic.

FIG. 6 illustrates a perspective view of the under hood service tray 10 as employed by a mechanic during the servicing or repair of an automobile 76. The service or repair may be performed on areas of the automobile 76 that are under the hood 78. For example, components in the engine compartment 80 may be serviced or repaired with the aid of mechanics tools 96 that are initially located on the under hood service tray 10. The tires 74 of the automobile 76 and the castors 14 of the under hood service tray 10 may be located on the same surface 82. The mechanic can roll the under hood service tray 10 across surface 82 so that the under hood service tray 10 is positioned at a desired location with respect to the automobile 76. In accordance with one exemplary embodiment, the tray 10 can be positioned so that the opening 68 defined by the legs 62, 64 and 66 has a portion of the front tire 74 of the automobile 76 located therein. The longitudinally extending legs 62 and 64 are wider than the width of the tire 76 so that the tire 74 can be located therebetween. The under hood service tray 10 is generally open between the base 12 and the tray 18 in the area forward of the vertical member 16. This open structure allows a portion of the automobile 76, such as a portion of the front bumper and the front fender, to be located therein. The vertical member 16 remains forward of or makes contact with the front bumper of the automobile 76. The tray 18 can be located at a position within the automobile 76 that allows easier access to mechanic tools 96 located on the tray 18 and allows easier placement of mechanic tools 96 onto the tray 18 during a repair or servicing procedure. A portion of the tray 18 may be located directly above the tire 74. Further, a portion of the tray 18 may be located above portions of the automobile 76 while other portions of the tray 18 are located outboard from the automobile 76 and are not located above any portion of the automobile 76. The angled side walls 50 and 52 of the tray 18 may allow for easier access to the engine compartment 80 as a portion of the tray 18 is narrower and is positioned so as to take up less space under the hood 78. Although shown as being used with the left front tire 74 of the automobile 76, it is to be understood that the under hood service tray 10 can be positioned next to the right front tire 74 in accordance with other exemplary embodiments.

Figure 7:
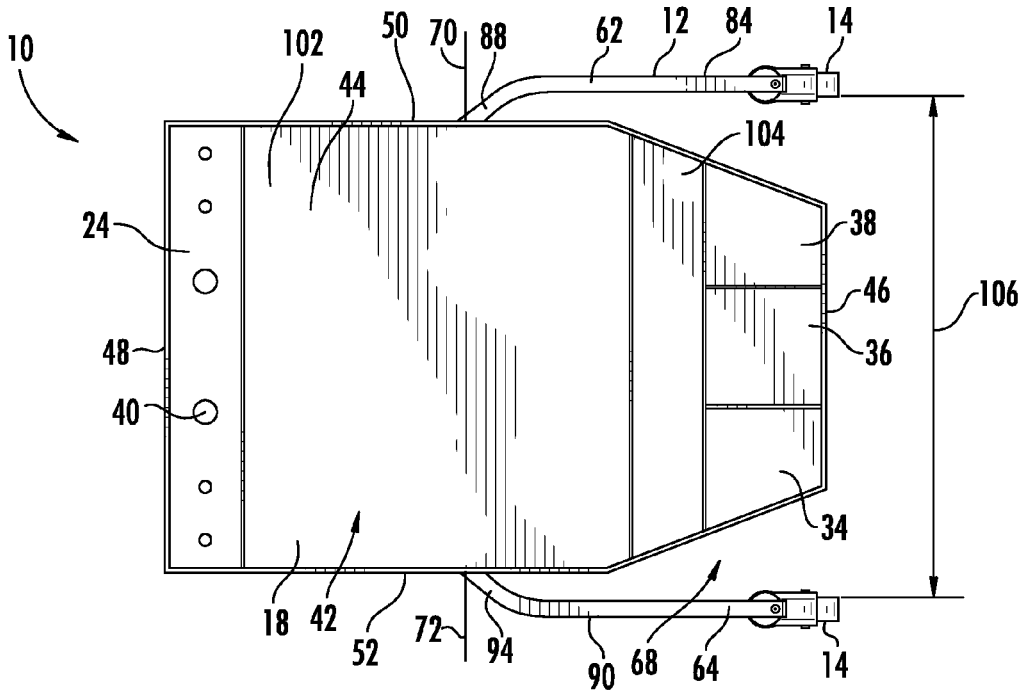
FIG. 7 is a top view of an under hood service tray in accordance with an alternative exemplary embodiment.
Figure 8:
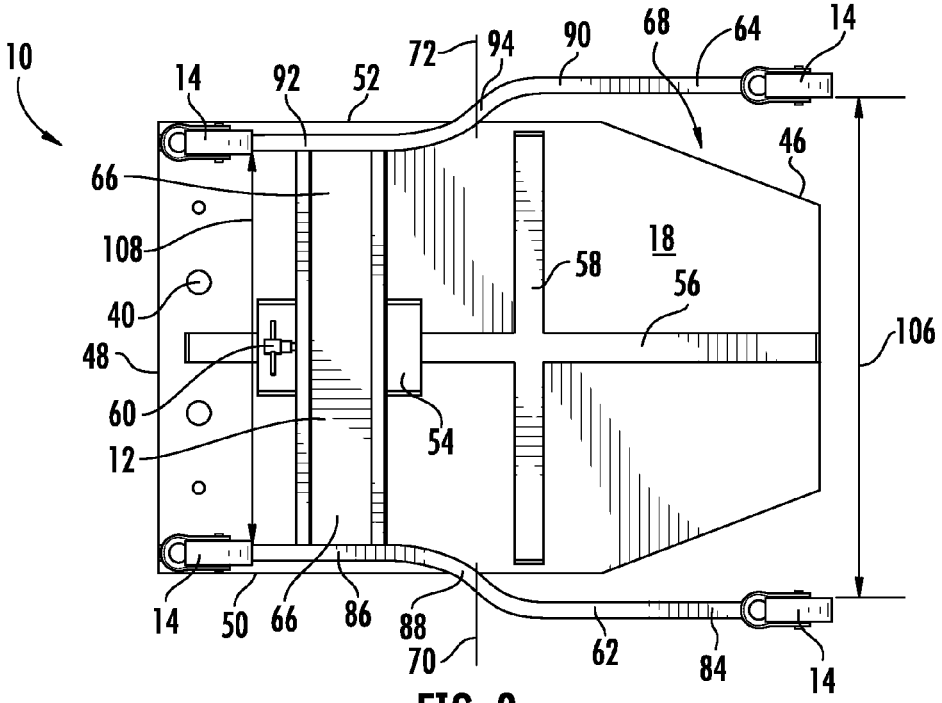
FIG. 8 is a bottom view of the under hood service tray of FIG. 7.

FIGS. 7 and 8 illustrate an alternative exemplary embodiment of the under hood service tray 10. As shown, the tray 18 has compartments 24, 34, 36 and 38 that are shaped and configured the same as those of tray 18 in earlier described embodiments. However, tray 18 as shown in FIGS. 7 and 8 also includes compartments 102 and 104 that are configured differently than those of earlier described embodiments. In this regard, compartment 104 is located adjacent compartments 34, 36 and 38, and compartment 102 is located adjacent compartments 24 and 104. Slip resistant material 44 is located within compartments 34, 36, 38, 102 and 104 and is not located within compartment 24.

The exemplary embodiment illustrated in FIGS. 7 and 8 includes a base 12 that is provided with a pair of longitudinally extending legs 62 and 64 and a laterally extending leg 66. Longitudinally extending leg 62 includes a first portion 84 that is located laterally outboard from a second portion 86. An intermediate portion 88 extends at least partially in the laterally outboard direction and is connected to both the first portion 84 and the second portion 86. In a similar manner, longitudinally extending leg 64 includes a first portion 90 that is located laterally outboard from a second portion 92. Intermediate portion 94 extends in the laterally outboard direction and is connected to both the first portion 90 and the second portion 92. The first portions 84 and 90 are parallel to one another and are located a greater distance apart than the second portions 86 and 92 that are also parallel to one another. The opening 86 may be made wider through the orientation of the longitudinally extending legs 62 and 64 so that the width of a tire 74 can be located therein to effect a desired positioning of the under hood service tray 10 with respect to the automobile 76.

The first portions 84 and 90 may be located a distance 106 from one another that can be 12 inches, from 12 inches to 18 inches, from 18 inches to 24 inches, or up to 36 inches in accordance with certain exemplary embodiments. Second portions 86 and 92 can be located a closer distance 108 that is less than the distance 106. Distance 108 may be up to 12 inches, up to 18 inches, or up to 24 inches in accordance with various exemplary embodiments. Distance 106 may be selected so that it is greater than the width of the tray 18 located along the same longitudinal length as the first portions 84 and 90. Distance 108 may be selected so that it is less than or equal to the width of the tray 18 that is along the same longitudinal length as the second portions 86 and 92.

The intermediate portions 88 and 94 extend in the lateral direction but not in the vertical direction so that all of the portions 84, 86, 90 and 92 are located at the same vertical height. In this arrangement, all of the castors 14 are identical to one another with respect to their circumference. However, castors 14 located closer to the vertical member 16 may have a higher load bearing capacity than the other castors 14 of the under hood service tray 10.

Figure 9:
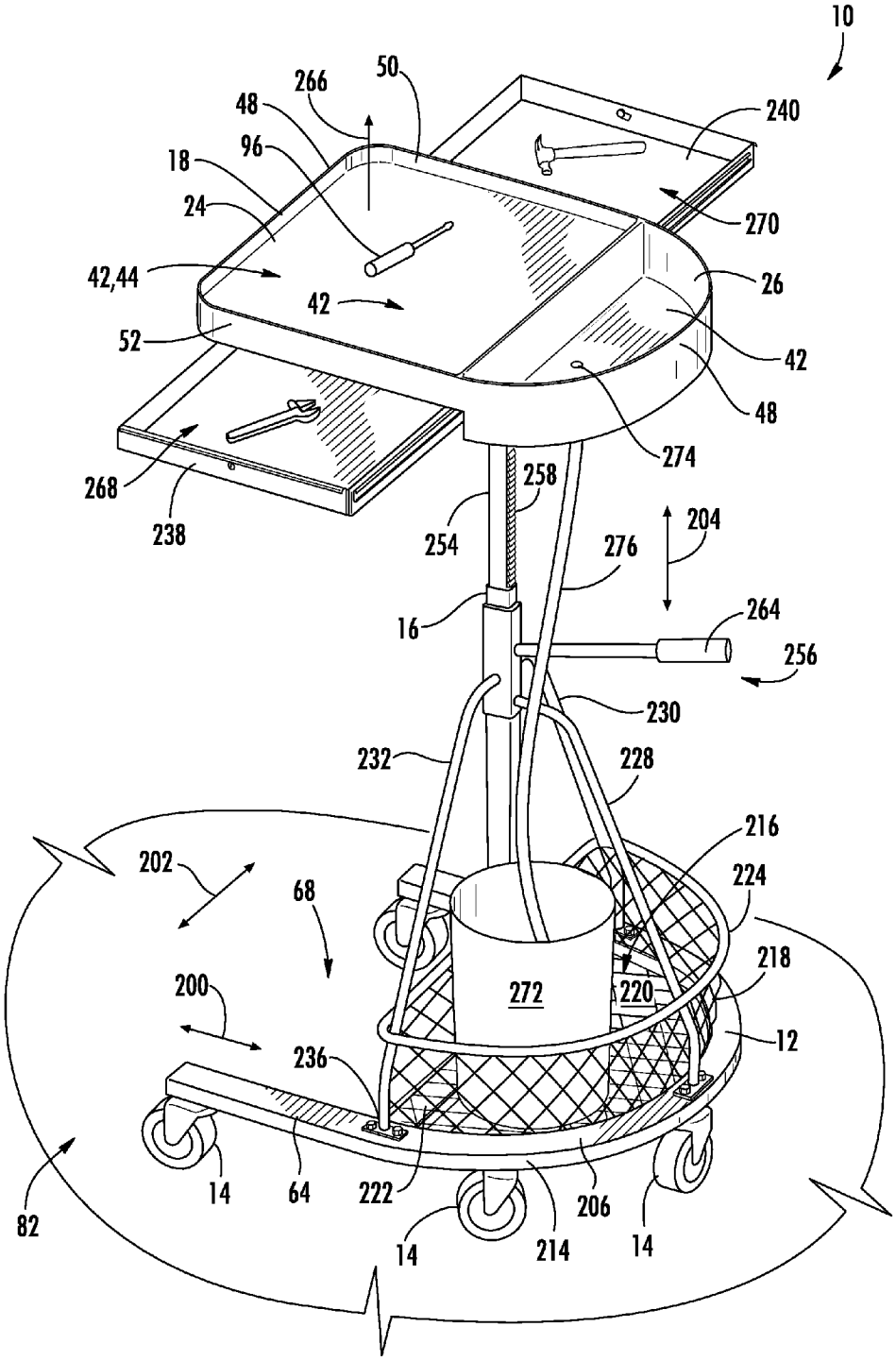
FIG. 9 is a perspective view of an under hood service tray in accordance with a different exemplary embodiment.

Another exemplary embodiment of the under hood service tray 10 is disclosed with reference to FIG. 9. The under hood service tray 10 includes an opening 68 into which a tire 74 of an automobile 76 may be positioned as previously discussed. Also included is an end leg 206 that at least partially supports a storage basket 218 into which objects, such as a bucket 272, can be located for use in carrying out one or more procedures. The height of the vertical member 16 may be adjusted in a vertical direction 204 so that the height of the tray 18 can likewise be adjusted in the vertical direction 204. An adjustment mechanism 256 that includes a handle 264 can be present so that the user can actuate handle 264 to raise the vertical member 16 and hence tray 18. The tray 18 may include a pair of laterally adjustable compartments 238 and 240 that can be moved in a lateral direction 202 between closed and open positions. Objects such as mechanics tools 96 can be located in the compartments 238 and 240 and can be stored when the compartments 238 and 240 are closed, and can be used when the compartments 238 and 240 are open.

Figure 11:
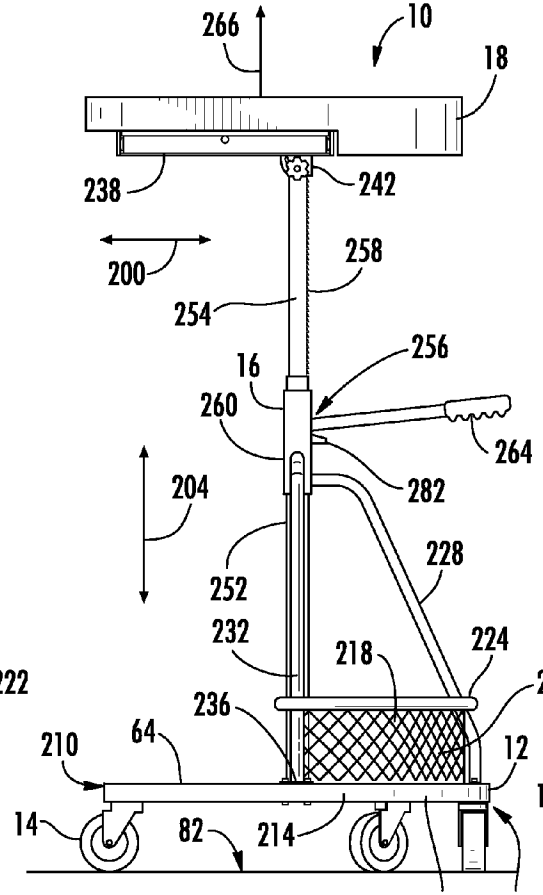
FIG. 11 is a side view of the under hood service tray of FIG. 9 in a high height position.
Figure 10:
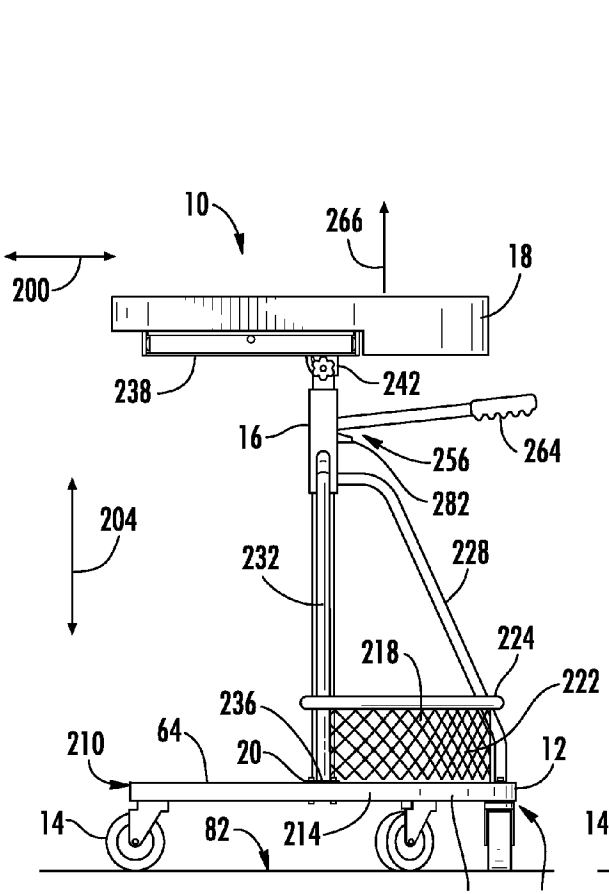
FIG. 10 is a side view of the under hood service tray of FIG. 9 in a low height orientation.

With reference now to FIGS. 10 and 11, the vertically adjusting feature of the under hood service tray 10 will now be explained. FIG. 10 illustrates the under hood service tray 10 in a low height position. The tray 18 is attached to the upper end of the vertical member 16. The vertical member 16 includes an outer column 252 that is rigidly attached to the base 12 so that the position of the outer column 252 with respect to the base 12 does not change. The outer column 252 may be welded or bolted to the laterally extending leg 66 and may be positioned at the lateral midpoint of the laterally extending leg 66 in the lateral direction 202. An inner column 254 is received within the outer column 252 in FIG. 10, and extends from the outer column 252 with reference to FIG. 11. The inner column 254 thus fits within the outer column 252 and its entire vertical length may be completely or partially contained within the outer column 252 in the low height position. The inner column 254 can be moved in the vertical direction 204 with respect to the outer column 252 in order to raise and lower the attached tray 18.

Figure 12:
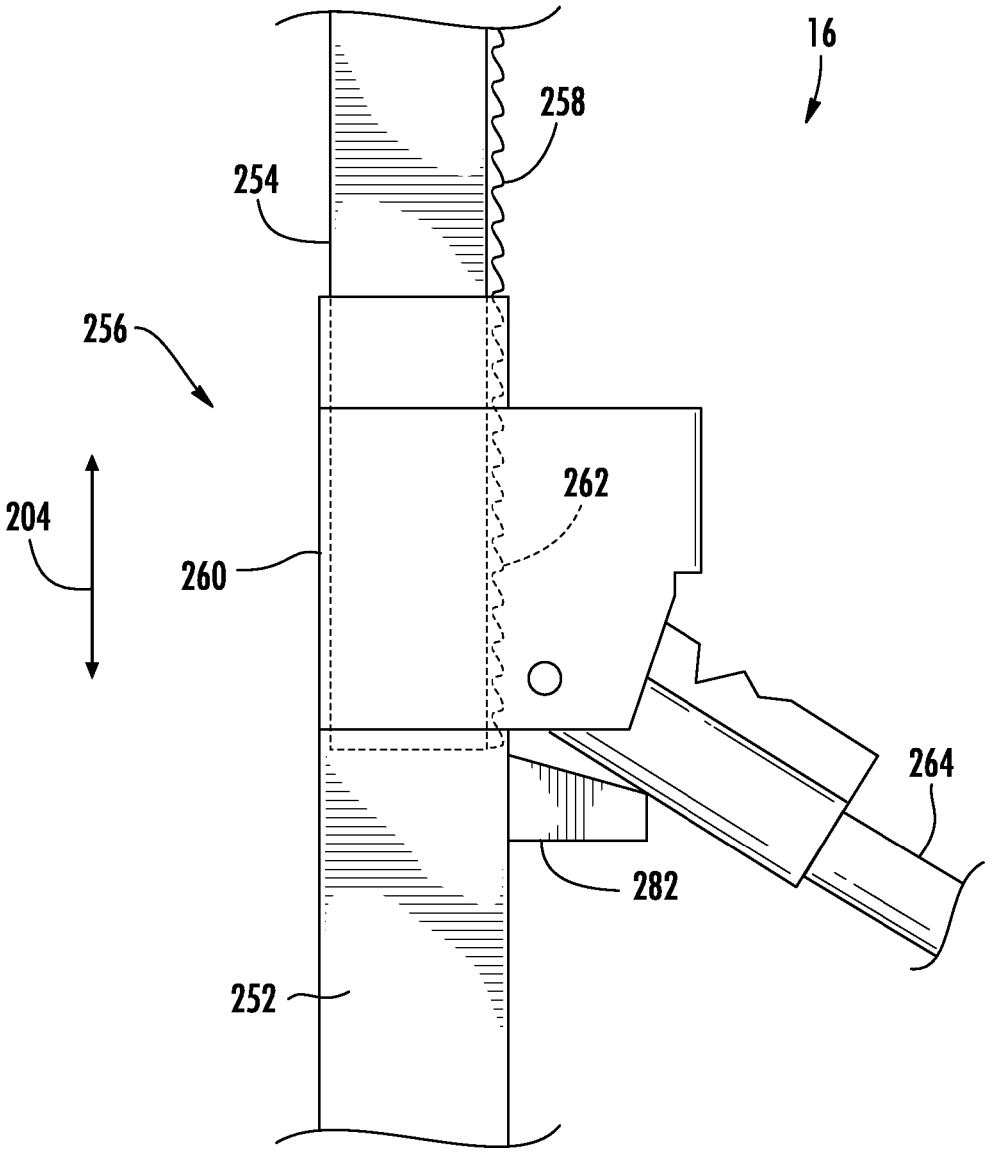
FIG. 12 is a close up side view of an adjustment mechanism for use in adjusting the height of the under hood service tray.

With reference now to FIG. 12, a close-up side view of an adjustment mechanism 256 is illustrated. The adjustment mechanism 256 includes an adjustment mechanism bracket 260 that is rigidly attached to the outer column 252. A ratchet member 262 is carried by the adjustment mechanism bracket 260. A handle 264 extends from the ratchet member 262 and is capable of being grasped by a user and actuated in order to cause movement of the inner column 254 with respect to the outer column 252. The handle 264 may be 18 inches in length in certain embodiments and may have a grip that is formed by way of a urethane dipping process. The handle 264 can be permanently attached to the ratchet member 262 or may be capable of being attached to and removed from the ratchet member 262. A handle stop 282 is rigidly attached to and extends from the outer column 252 in the longitudinal direction 200. The handle 264 may be actuated so as to move in an arc having components in both the longitudinal and vertical directions 200 and 204. The handle 264 may engage the handle stop 282 so that it can be supported by the handle stop 282 when not being used, and so that its arc length range can be limited.

One side of the inner column 254 is provided with a series of linear teeth 258. As shown, the linear teeth 258 are located on the side of the inner column 254 that faces in the longitudinal direction 200 towards a first end 208 of the base 12. The ratchet 262 is adapted for engaging the linear teeth 258 so as to move the inner column 254 upwards. The engagement of the ratchet member and linear teeth along with suitable release mechanisms so as to lower inner column 254 are well known in the art. A variety of similar ratchet mechanisms from automotive lifts and similar devices may be utilized.

Figure 13:
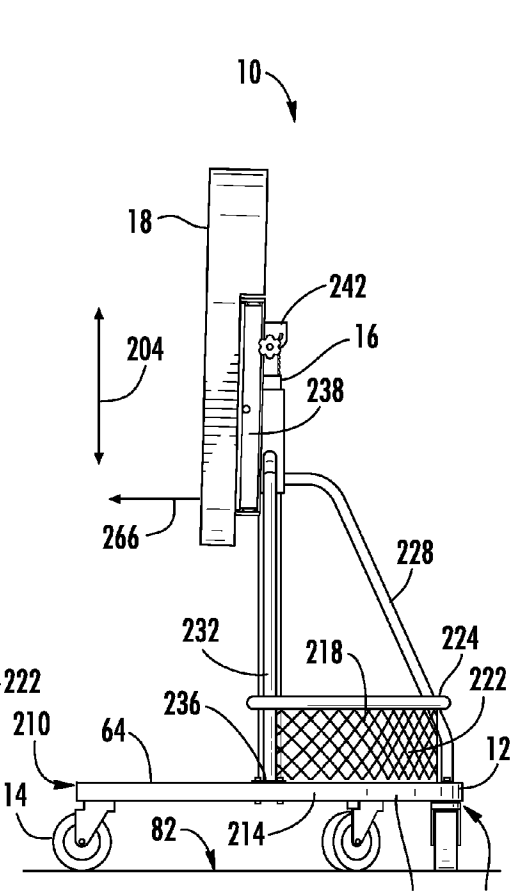
FIG. 13 is a side view of the under hood service tray in a storage position.

The vertical member 16 can be configured so that it may be raised a distance of 18 inches in the vertical direction 204 from the low height position in FIG. 10 to the high height position in FIG. 11. The user may adjust the height of the tray 18 as desired so that the tray 18 is at a convenient height in the vertical direction 204 when conducting procedures in conjunction with the use of the under hood service tray 10. After use of the under hood service tray 10, it can be configured into a storage position as illustrated with reference to FIG. 13. Here, the user can first remove any loose objects, such as mechanics tools 96, from the open compartments of the tray 18. Next, the user may disengage a locking pin 250 so that the tray 18 can be rotated into the position shown in which a surface normal 266 of the upper surface 42 of the tray 18 extends in the longitudinal direction 200 and does not have a component that extends in the vertical direction 204. However, in other arrangements, the surface normal 266 of the upper surface 42 may in fact have a component that extends in the vertical direction 204 when in the storage position, although the surface normal 266 will primarily be oriented in the longitudinal direction 200. The height of the vertical member 16 can be adjusted when the tray 18 is in the storage position so that the tray 18 can be in a high or low position. However, the user will generally place the tray 18 in the low position when the tray 18 is oriented into the storage position so that the under hood service tray 10 is arranged into a more compact size for easier storage.

Figure 14C:
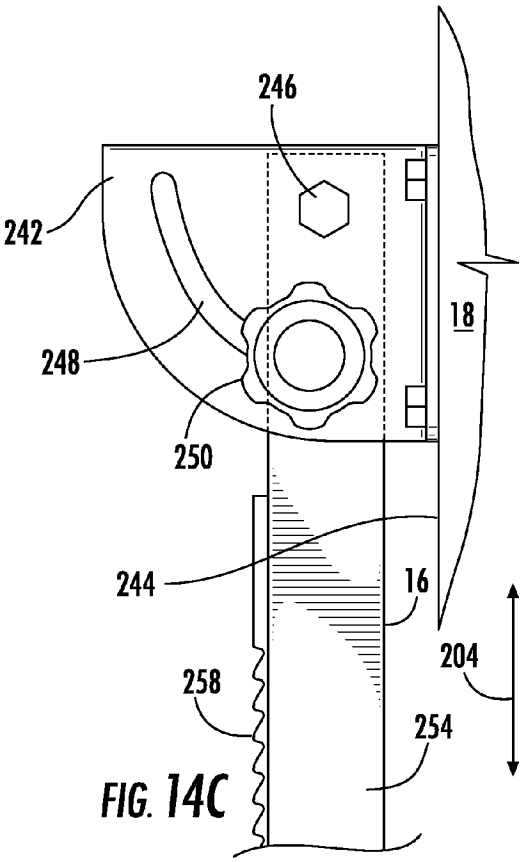
FIG. 14C is a close up side view of the tray bracket and related components of FIG. 14A in which the tray is in the storage position.
Figure 14B:
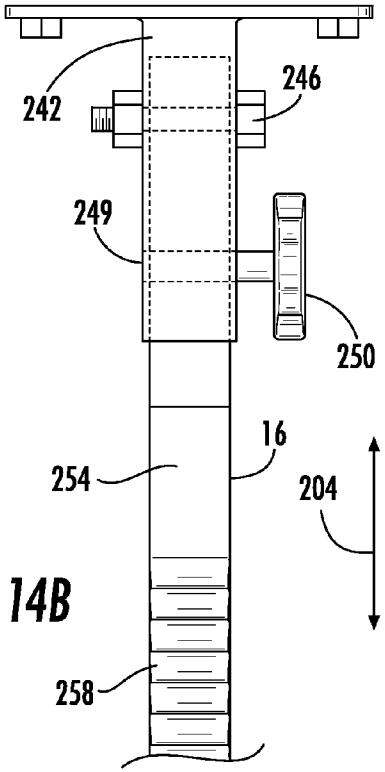
FIG. 14B is a close up front view of the tray bracket and related components of FIG. 14A.
Figure 14A:
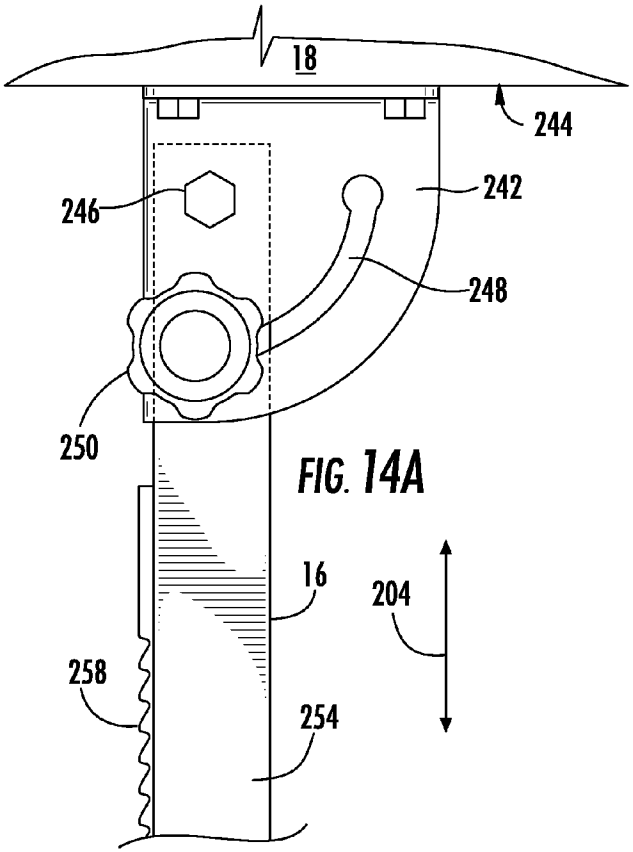
FIG. 14A is a close up side view of a tray bracket and related components arranged for tilting of the tray in which the tray is in the use position.

FIGS. 14A-14C disclose a mechanism responsible for pivoting the tray 18 back and forth between the use position and the storage position. A tray bracket 242 may be rigidly attached to a bottom 244 of the tray 18 by either welding, mechanical fasteners, or by being integrally formed therewith. The bottom 244 can be a flat planar surface or may be a mounting bracket 54, as previously disclosed, or may be any portion of the tray 18 located opposite the upper surface 42 in the vertical direction 204. The tray bracket 242 extends downward from the bottom 244 in the vertical direction and has a pair of ears that are closed on one end but open on an opposite end and open at the bottom. The inner column 254 is pivotally attached to the tray bracket 242 by way of a pivot pin 246. The pivot pin 246 extends through both ears of the tray bracket 242 and through the inner column 254. With this arrangement, the tray bracket 242 and hence tray 18 can pivot about the pivot pin 246. The closed side end of the tray bracket 242 may engage a longitudinally facing surface of the inner column 254 so that the tray bracket 242 cannot pivot past this point. As such, engagement with the inner column 254 will act as a limit to the pivoting range of the tray bracket 242.

FIGS. 14A and 14B show the tray bracket 242 and tray 18 in the use position, and they may be locked into this position through the use of a locking pin 250. A slot 248 is defined through one of the ears of the tray bracket 242. The locking pin 250 may extend through the slot 248 and then through the inner column 254 and through an aperture 249 defined through the other ear of the tray bracket 242. With reference in particular to FIG. 14B, the locking pin 250 extends through both of the ears of the tray bracket 242 and through the inner column 254. The locking pin 250 may be provided with external threading and the inner column 254 may have an aperture that is internally threaded to receive the complimentary external threading of the locking pin 250. In other exemplary embodiments, threading is not used. Engagement of the locking pin 250 onto the tray bracket 242 causes the position of the tray bracket 242 to be locked with respect to the inner column 254 so that the tray bracket 242 does not pivot about the pivot pin 246.

The user may unscrew the locking pin 250 or otherwise unlock the locking pin 250 so that the locking pin 250 becomes disengaged with the ear of the tray bracket 242 that does not include the slot 248. The locking pin 250 can be moved out of aperture 249 to effect this disengagement. The slot 248 is arc shaped in length to allow for pivoting of the tray bracket 242 about the pivot pin 246. Once the locking pin 250 is disengaged from the left ear in FIG. 14B, the tray bracket 242 can pivot about the pivot pin 246 so that the locking pin 250 slides within the slot 248. The position of the locking pin 250 and the inner column 254 will not change. The tray bracket 242 can be positioned into the storage position as shown with reference to FIG. 14C. The locking pin 250 thus engages the opposite side of the slot 248 from that in FIG. 14A. The tray bracket 242 may have a surface that engages a side of the inner column 254 that faces in the longitudinal direction 200. As such, engagement between the tray bracket 242 and the inner column 254 may function to limit the amount of rotation of the tray bracket 242 about the pivot pin 246. The tray bracket 242 may be locked into the position shown in FIG. 14C by the user grasping and rotating the locking pin 250 so that it is once again inserted into the aperture 249 present on the left ear of the tray bracket 242 as previously discussed with respect to FIG. 14B. The user may reverse these steps in order to change the position of the tray 18 from the storage position of FIG. 14C back to the use position of FIGS. 14A and 14B.

Figure 15:
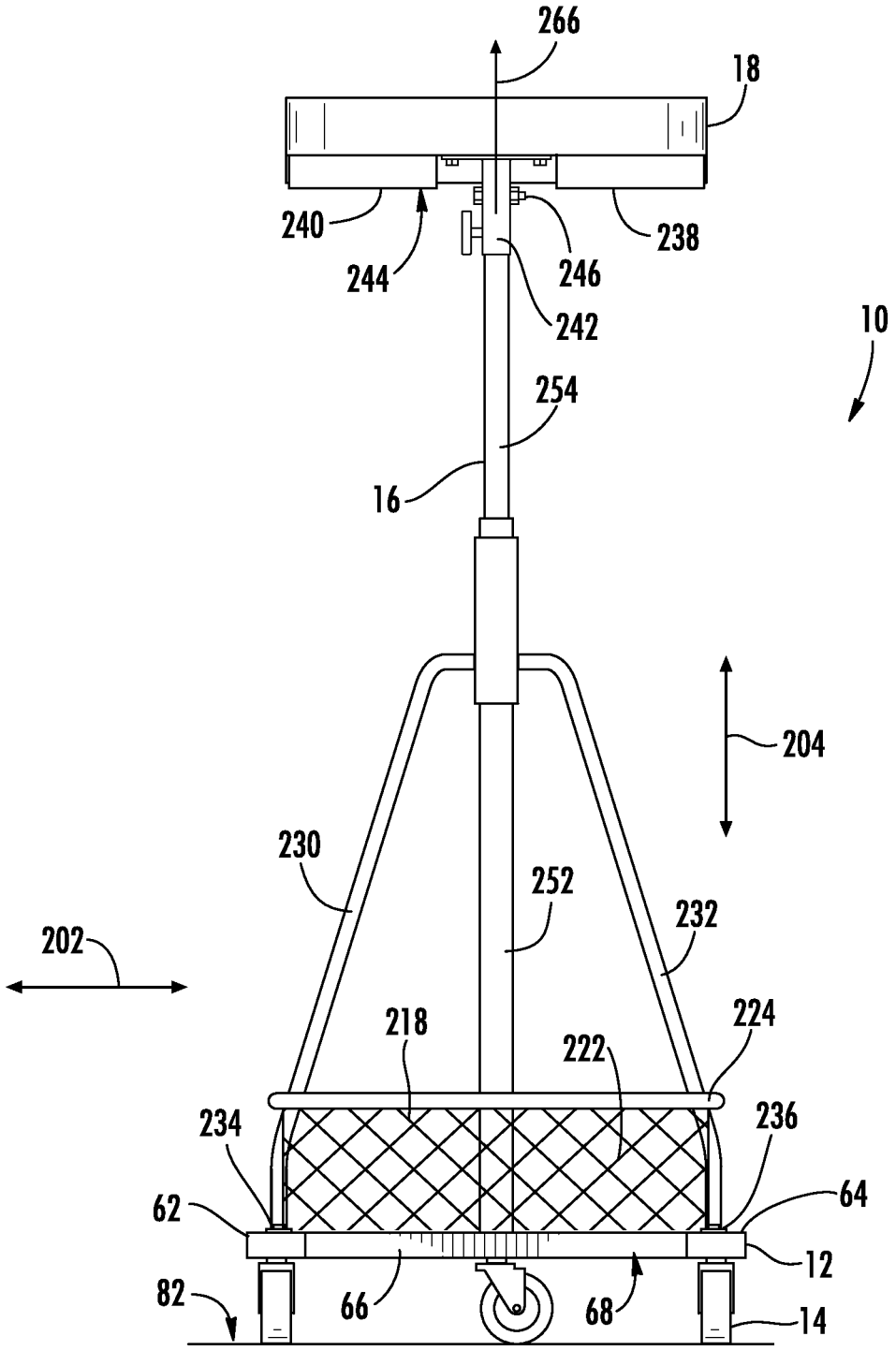
FIG. 15 is a front view of the under hood service tray of FIG. 9.
Figure 16:
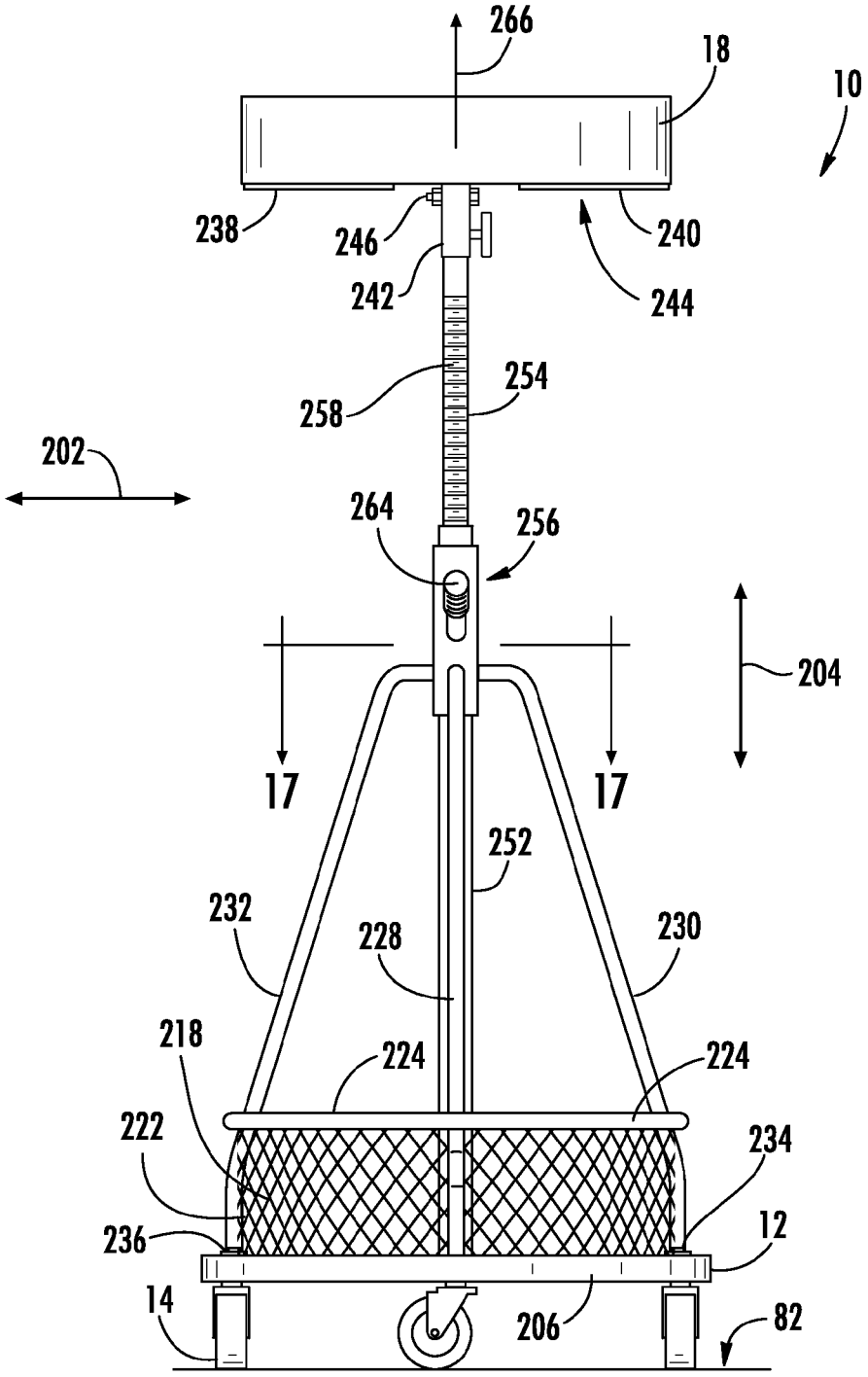
FIG. 16 is a back view of the under hood service tray of FIG. 9.
Figure 17:
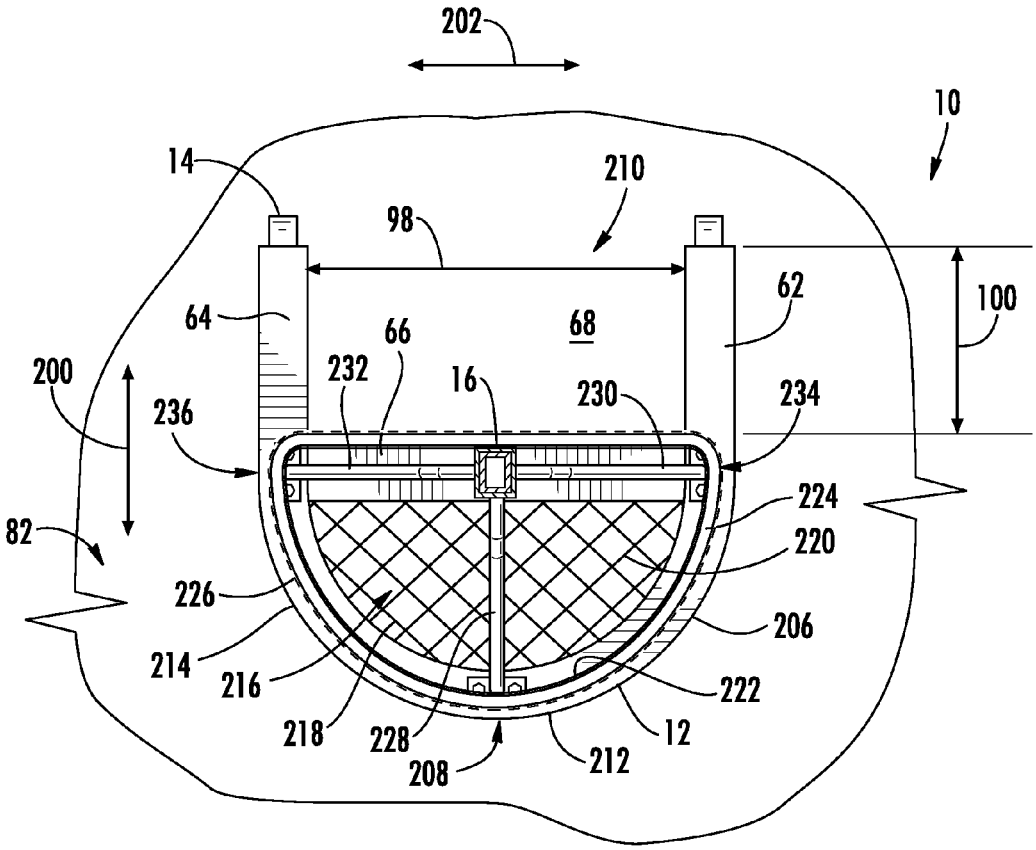
FIG. 17 is a cross-sectional view taken along line 17-17 of FIG. 16.

With reference now to FIGS. 15-17, the under hood service tray 10 in the raised position is illustrated. As disclosed with previous exemplary embodiments, the base 12 includes a first longitudinally extending leg 62, a second longitudinally extending leg 64, and a laterally extending leg 66 that can be arranged as previously described. The second end 210 of the base 12 is open so that an opening 68 is defined to allow the tire 74 of an automobile 76 to be inserted therein so that the tray 18 can be appropriately placed when using the under hood service tray 10. The opening 68 may be rectangular in shape as viewed from above with reference to FIG. 17.

The base 12 may include an end leg 206 that extends so as to be primarily located beyond the laterally extending leg 66 in the longitudinal direction 200. The end leg 206 may be integrally formed with the legs 62, 64 and 66 or all of these legs may be separate components that are attached to one another. The end leg 206 may extend from both of the longitudinally extending legs 62 and 64 and need not engage the laterally extending leg 66. Alternatively, the end leg 206 may engage the laterally extending leg 66 and need not engage either one of the longitudinally extending legs 62 and 64 in certain arrangements. In yet other exemplary embodiments, the end leg 206 terminates so that it engages the first longitudinally extending leg 62 and laterally extending leg 66 on one side, and on a laterally opposite side engages both the second longitudinally extending leg 64 and the laterally extending leg 66.

The end leg 206 may be of any cross-sectional shape such as circular, rectangular, or channel. The end leg 206 extends in both the longitudinal direction 200 and the lateral direction 202 so that it extends from one lateral side of the base 12 to an opposite lateral side of the base 12. In the exemplary embodiment illustrated, the end leg 206 is in the shape of a semicircle. The end leg 206 has a first portion 212 that may represent one half of the end leg 206 as extending from the first longitudinally extending leg 62. The first portion 212 extends from the first longitudinally extending leg 62 so as to have a component that extends in the longitudinal direction 200 and a component that extends in the lateral direction 202. The first portion 212 is a curved portion that extends towards the lateral midline of the base 12. The end leg 206 also includes a second portion 214 that extends from the second longitudinally extending leg 64. The second portion 214 is also curved and extends from the second longitudinally extending leg 64 so as to have a component that extends in the longitudinal direction 200 and to have a component that extends in the lateral direction 202.

The end leg 206 extends from one lateral side of the base 12 to the other so that the first end 208 of the base 12 a closed end. As such, a tire 74 cannot be positioned past the first end 208 as is the case with the open second end 210. The end leg 206 extends in such a manner that an open space is formed between the laterally extending leg 66 and the end leg 206 that is a closed opening 216. The closed opening 216 need not be present in other exemplary embodiments in which the end leg 206 extends in such a manner that a space is not present between the laterally extending leg 66 and the end leg 206. The first end 208 may be a closed end even if the closed opening 216 is not present.

A storage basket 218 is present in order to accommodate the storage or holding of items. The storage basket 218 may include a bottom wall 220 that extends over the entire closed opening 216. A side wall 222 of the storage basket 218 may extend upwards from the bottom wall 220. The side wall 222 may be arranged so that it extends from the upper surfaces of both the laterally extending leg 66 and the end leg 206. The top of the storage basket 218 may be open. However, in other exemplary embodiments, a cover may be used to close the top of the storage basket 218 that may be opened and closed as desired in order to afford access. The bottom wall 220 and side wall 222 may be made of any type of material, such as metal or plastic. In certain arrangements, the walls 220 and 222 are made of black steel mesh. In yet other exemplary embodiments, the walls 220 and 222 can be solid walls that are transparent, semi-transparent, or opaque.

The storage basket 218 may include a support ring 224. The support ring 224 can have a circular cross-sectional shape and may define a closed perimeter 226. The perimeter 226 may be of the same shape as the laterally extending leg 66 and the end leg 206 as viewed from the top as illustrated with reference to FIG. 17. As such, the perimeter 226 may have a semi-circular portion along with a linear portion. The side wall 222 may be connected to the support ring 224 so that the side wall 222 hangs downward from the support ring 224. This connection may be effected through welding, adhesion, or mechanical fasteners. The bottom wall 220 can be connected to the end leg 206 and the laterally extending leg 66 through the same forms of attachment. Additionally, the side wall 222 can be connected to the outer column 252 along a portion of its length or along its entire length.

A first support member 228 extends from the end leg 206 and engages the vertical member 16 at either the outer column 252 or at the adjustment mechanism bracket 260 rigidly attached to the outer column 252. The first support member 228 extends in both the longitudinal direction 200 and the vertical direction 204 and functions to support the vertical member 16. A second support member 230 and a third support member 232 may also be present and engage either the adjustment mechanism bracket 260 or other portion of the outer column 252 in order to provide further structural support to the vertical member 16. The second and third support members 230 and 232 extend from the base 12 in both the lateral direction 202 and the vertical direction 204. The second support member 230 engages the base 12 at a second support member location 234. The second support member location 234 may be at either the first longitudinally extending leg 62, at the laterally extending leg 66, at the end leg 206, or at some combination of the three. The second support member 230 may be welded or otherwise rigidly attached to the base 12 at the second support member location 234.

In a similar manner, the third support member 232 is attached to the base 12 at a third support member location 236. The third support member location 236 may be at the second longitudinally extending leg 64, at the laterally extending leg 66, at the end leg 206, or at some combination of these three legs. The third support member 232 can be welded or otherwise rigidly attached to the base 12 at the third support member location 236. The third support member location 236 may be located on a laterally opposite side of the vertical member 16 from the second support member location 234. In this regard, the second support member location 234 may be at a distance from the outer column 252 that is the same in the lateral direction 202 as the distance from the third support member location 236 to the outer column 252. Although these lateral distances may be the same, the locations 234 and 236 may be on opposite sides of the vertical member 16.

The second and third support members 230 and 232 may engage either the outer column 252 or the adjustment mechanism bracket 260. The engagement of the second and third support members 230 and 232 at their upper ends may be at locations that are higher than that of the engagement of the first support member 228 in the vertical direction 204. In accordance with other exemplary embodiments, all of the support members 228, 230, and 232 engage the vertical member 18 at their upper ends at locations that have the same height in the vertical direction 204.

The support ring 224 is positioned so that the support members 228, 230 and 232 extend through the support ring 224 so as to be located within the perimeter 226 of the support ring 224. In other exemplary embodiments, one or more of the support members 228, 230 and/or 232 may extend outside of the perimeter 226 of the support ring 224. The support ring 224 may engage the three support members 228, 230 and 232 and can be attached thereto. This attachment may be effected through welding, adhesion, mechanical fasteners, or through integral formation. The side wall 222 of the storage basket 218 may engage and be attached to one or more of the support members 228, 230 and/or 232 in certain arrangements. The support members 228, 230 and 232 may thus function to hold the support ring 224 and in turn support the storage basket 218.

The under hood service tray 10 may be rendered mobile through the provision of castors 14 on the underside of the base 12. One of the castors 14 can be located at the second end 210 of the base at the first longitudinally extending leg 62, and a second one of the castors 14 can be positioned at the second end 210 at the second longitudinally extending leg 64. A third castor 14 can be located at the first end 208 at the end leg 206 so as to be at the farthest portion of the end leg 206 in the longitudinal direction 200. The third castor 14 may be located at the junction of the first portion 212 and second portion 214 of the end leg 206. A fourth castor 14 can be located at the first portion 212 at a location in the longitudinal direction 200 that is half-way between the laterally extending leg 66 and the third castor 14. In a similar manner, the fifth castor 14 can be located at the second portion 214 at a longitudinal distance that is half-way between the laterally extending leg 66 and the third castor 14. Any number of castors 14 can be employed in other exemplary embodiments, and the positioning of the castors 14 may be varied in yet other arrangements. Further, the castors 14 may all be of the same size and type, or may be of various sizes and types as desired.

The under hood service tray 10 may include a tray 18 that has an upper surface 42 with slip resistant material 44 disposed thereon. The slip resistant material 44 may be an eva foam liner in certain embodiments. A pair of compartments 24 and 26 may be defined on the upper surface 42 of the tray 18. The first compartment 24 may be defined by the front wall 46, side wall 50, side wall 52, and a dividing wall. The first compartment 24 may be open and objects such as mechanics tools 96 can be placed within the first compartment 24. The second compartment 26 may be defined by the rear wall 48 and the wall that divides the second compartment 26 from the first compartment 24. The second compartment 26 may be open. With reference back to FIG. 9, the second compartment 26 is arranged so as to be a recessed compartment from that of the first compartment 24. In this regard, the upper surface 42 of the second compartment 26 is located at a different height in the vertical direction 204 than the height of the upper surface 42 of the first compartment 24. In other exemplary embodiments, the height of the upper surface 42 of both the first and second compartments 24 and 26 are the same so that none of the compartments 24 or 26 are recessed. Recessing of the second compartment 26 may allow for additional, or larger objects 96 to be stored therein.

An aperture 274 may extend through the second compartment 26. The aperture 274 may extend completely through the tray 18 such that it extends from the upper surface 42 through the bottom 244 of the tray 18. A hose 276 may be in communication with the aperture 274 so that fluid present within the second compartment 26 or otherwise transferred to the aperture 274 travels through the aperture 274 and drains through hose 276 and into a bucket 272 that can be positioned and stored within the storage basket 218. Such an arrangement may facilitate the drainage of fluid associated with the vehicle that is being serviced or repaired with use of the under hood service tray 10.

Figure 18:
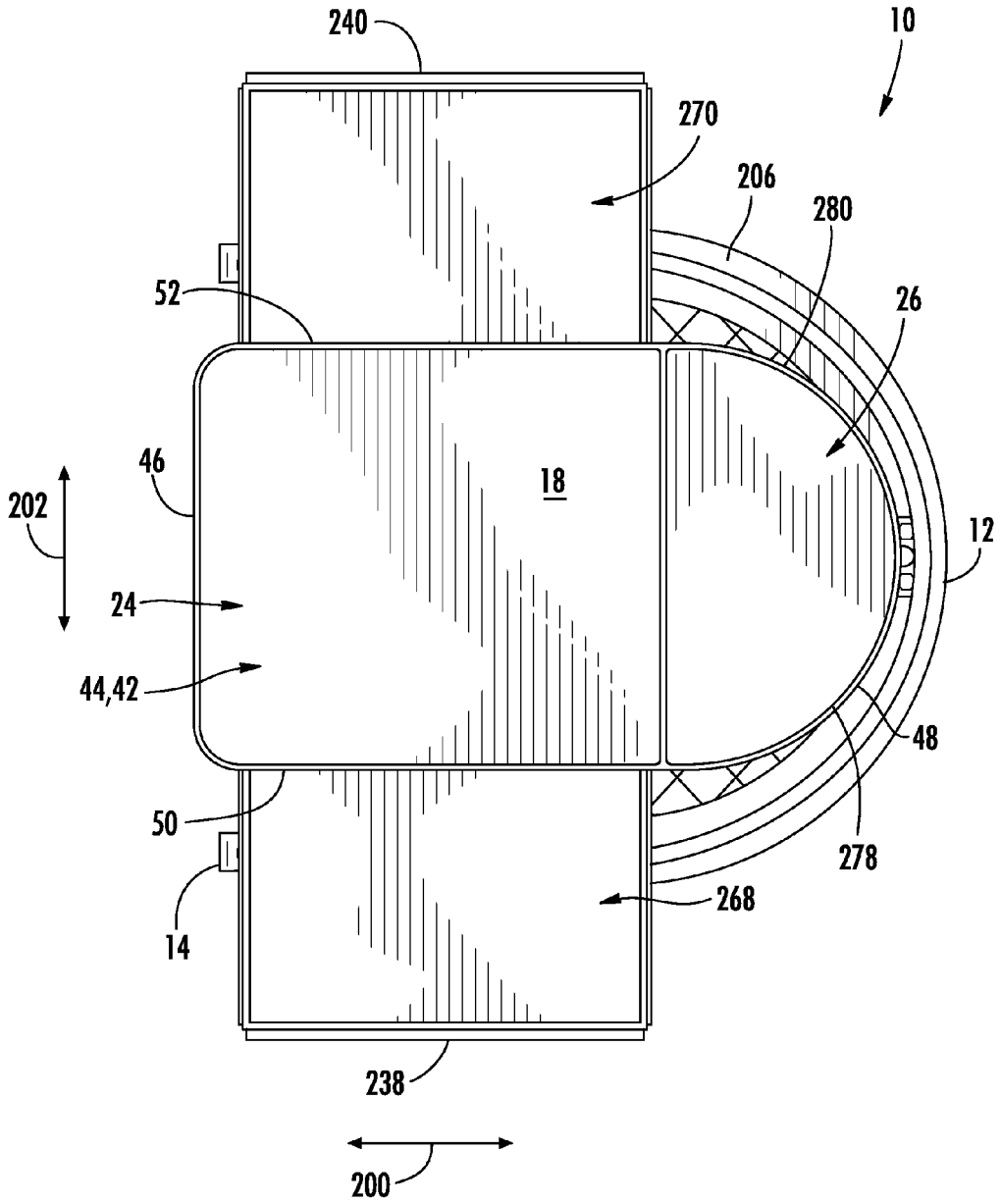
FIG. 18 is a top view of the under hood service tray of FIG. 9 with a pair of laterally adjustable compartments both in an open position.

With reference now to FIG. 18, the rear wall 48 is disclosed as being curved in shape such that it assumes a generally semi-circular shape. The rear wall 48 may be described as having a first portion 278 that engages the side wall 50. The first portion 278 has a component that extends in both the longitudinal direction 200 and has a component that extends in the lateral direction 202. In other arrangements, a section of the first portion 278 may extend only in the longitudinal direction 200 while another section of the first portion 278 has a component in both the longitudinal and lateral directions 200 and 202. The entire length of the first portion 278 is curved as disclosed, however, in the exemplary embodiment of FIG. 18.

The second portion 280 of the rear wall 48 extends from the side wall 52 and has a component that extends in the longitudinal direction 200 and a component that extends in the lateral direction 202. The second portion 280 is entirely curved in shape, however it may be arranged as previously described with respect to the first portion 278 in other exemplary embodiments. The rear wall 48 is thus curved while the front wall 46 is straight and extends in the lateral direction 202 but not in the longitudinal direction 200. In other exemplary embodiments of the under hood service tray 10, the front wall 46 and rear wall 48 can be variously arranged so that they may extend in the longitudinal direction 200 and/or the lateral direction 202. The curvature of the rear wall 48 may conform to the curvature of the end leg 206 so that these two components are somewhat similarly shaped. The rear wall 48 that is curved may be located in the longitudinal direction 200 towards the end leg 206 and away from the opening 68 of the base 12.

The tray 18 includes a first laterally adjustable compartment 238 and a second laterally adjustable compartment 240 that are adjustable in the lateral direction 202 between closed positions as illustrated in FIG. 15 and open positions as disclosed with reference to FIGS. 9 and 18. When the surface normal 266 of the upper surface 42 of tray 18 extends completely in the vertical direction 204, for example when the tray 18 is oriented as shown with reference to FIG. 15, the compartments 238 and 240 move completely in the lateral direction 202. The surface normal of surfaces 268 and 270 may extend completely upwards in the vertical direction 204 and can be parallel with the surface normal 266 of the upper surface 42. The compartments 238 and 240 may each have a width of 461 millimeters, a depth of 298 millimeters, and a height of 44 millimeters. The compartments 238 and 240 can be self contained modules that are bolted onto the bottom of the portion of tray 18 that forms the upper compartments 24 and 26. The compartments 238 and 240 may form a portion of the bottom 244 of the tray 18 in some embodiments. The compartments 238 and 240 may each be provided with a lock so that a user can secure objects such as tools 96 or other items stored within the under hood service tray 10. The compartments 238 and 240 may include roller bearing slides that allow the compartments 238 and 240 to be easily slid between the open and closed positions.

The surfaces 268 and 270 of the first and second laterally adjustable compartments 238 and 240 may be coated with a slip resistant material 44. Although disclosed as being a single, undivided area, the interior of the compartments 238 and 240 may be divided up in manners similar to that disclosed with respect to the compartments on the upper portion of the tray 18. The compartments 238 and 240 can be opened to increase the surface area available for objects 96 on the surface of the tray 18. The user may open and close the compartments 238 and 240 as desired during use of the under hood service tray 10. In other exemplary embodiments, only a single compartment 238 is present. In yet other exemplary embodiments, no compartments 238 or 240 are present. In still other arrangements of the under hood service tray 10, from 3-15 compartments capable of being opened and closed are present. Although described as opening in the lateral direction 202, the compartments 238 and 240 may be arranged so that they open in the longitudinal direction 200 or the vertical direction 204 in other exemplary embodiments.

Figure 19:
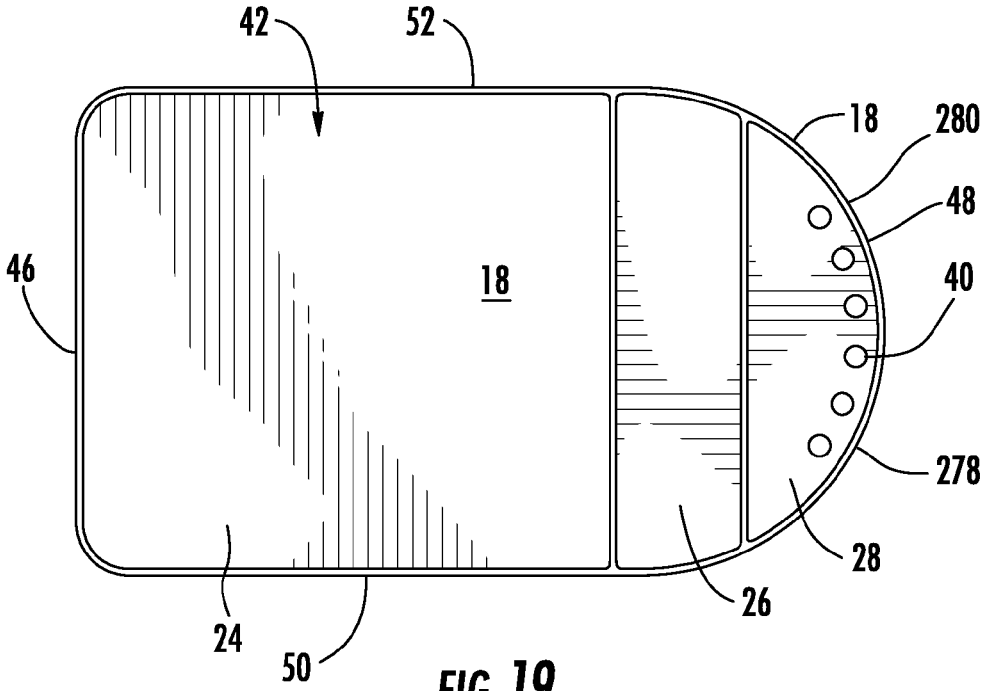
FIG. 19 is a top view of a tray in accordance with another exemplary embodiment.

FIG. 19 discloses an alternate exemplary embodiment of the tray 18. Three compartments 24, 26 and 28 are defined on the upper surface 44 of the tray 18. The compartments 24, 26 and 28 are arranged so that the front wall 46 is linear and extends in the lateral direction 202 and so that the rear wall 48 is curved and semi-circular in shape. The rear wall 48 has a first portion 278 and a second portion 280 that both extend in the lateral direction 202 and longitudinal direction 200. The curved rear wall 48 is on an end of the tray 18 that faces in the same direction as the end leg 206 of the base 12 in the longitudinal direction 200, and the straight front wall 48 faces towards the front of the under hood service tray 10 in the same manner as the opening 68 in the longitudinal direction 200. A plurality of apertures 40 are defined through compartment 28 of the tray 18. Drain hoses, air hoses, electrical lines, and other members may be disposed through the apertures 40. Any number of apertures 40 can be present in other exemplary embodiments. In other arrangements from 1-5, from 6-10, or up to 20 apertures 40 may be present. The apertures 40 may all be located within a single one of the compartments, or may be in multiple compartments. Further, one or more apertures 40 may be present within the first and second laterally adjustable compartments 238 and 240 and can extend in the vertical direction completely through the surfaces 268 and 270.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An under hood service tray, comprising:

a base having a plurality of castors to render the base mobile on a surface onto which the base is located;

a vertical member comprising a lower end attached to the base and an upper end with an aperture formed therethrough, the vertical member extending from the base in a vertical direction so that the upper end is distal from the base, wherein the vertical member is adjustable in the vertical direction from a low height position to a high height position; and a tray comprising an upper surface, an opposing bottom and a tray bracket that extends from the tray bottom with the tray bracket having a slot formed therethrough, the tray pivotally attached to the vertical member by the tray bracket being fixedly but rotatably secured by a pivot pin that extends through the upper end of the vertical member, the tray is capable of being pivoted from a position where the tray extends over the upper end of the vertical member in which a surface normal directional vector of the upper surface of the tray extends in the vertical direction to a position beside the vertical member in which the surface normal directional vector of the upper surface of the tray extends in a longitudinal direction; and a locking pin that is extendable through the slot of the tray bracket to engage the aperture in the upper end of the vertical member so as to fix the position of the tray in the position where the tray extends over the upper end of the vertical member;

wherein the base has a first longitudinally extending leg and a second longitudinally extending leg that are spaced from one another in a lateral direction, wherein the base has a laterally extending leg that extends in the lateral direction and engages the first and second longitudinally extending legs;

wherein the first longitudinally extending leg, the second longitudinally extending leg, and the laterally extending leg define an opening such that a second end of the base opposite a first end of the base is open;

wherein the base has an end leg located on the first end of the base, wherein the first end of the base is closed, wherein the end leg has a first portion that has a component that extends in the lateral direction, and wherein the end leg has a second portion that has a component that extends in the longitudinal direction; and wherein when the tray is in the position such that the surface normal directional vector of the upper surface of the tray extends in the longitudinal direction, the tray is arranged such that the surface normal directional vector extends from the upper surface in the same direction as that of the first end of the base to the second end of the base in the longitudinal direction.

2. The under hood service tray as set forth in claim 1, wherein the locking pin is capable of being disengaged from a portion of the tray bracket to allow the position of the locking pin in the slot to be changed to allow the tray to pivot with respect to the vertical member.

3. The under hood service tray as set forth in claim 1, wherein the vertical member has an outer column that is rigidly attached to the base such that the position of the outer column does not change with respect to the base, wherein the vertical member has an inner column that is received within the outer column and that moves with respect to the outer column in the vertical direction when the vertical member is adjusted in the vertical direction from the low height position to the high height position, wherein the vertical member has an adjustment mechanism that is capable of being actuated by a user in order to adjust the height of the vertical member in the vertical position.

4. The under hood service tray as set forth in claim 3, wherein the inner column has a series of linear teeth disposed thereon, wherein the adjustment mechanism has an adjustment mechanism bracket that is attached to the outer column, wherein the adjustment mechanism has a ratchet member that is pivotally attached to the adjustment mechanism bracket and that engages the teeth of the inner column, wherein the adjustment mechanism has a handle that engages the ratchet member and is capable of being actuated by the user in order to pivot the ratchet member to effect movement of the inner column with respect to the outer column in the vertical direction.

5. The under hood service tray as set forth in claim 1, wherein the laterally extending leg and the end leg define a closed opening, and further comprising a storage basket carried by the base, wherein the storage basket has a bottom wall that extends over the closed opening, and wherein the storage basket has a side wall that extends in a vertical direction, and wherein a top of the storage basket is open;

wherein the vertical member engages the laterally extending leg, and further comprising a first support member, a second support member, and a third support member for use in supporting the vertical member, wherein the first support member engages the vertical member and the end leg, wherein the second support member engages the vertical member and engages the base at a second support member location that is at the same distance from the vertical member as a portion of the first longitudinally extending leg in the lateral direction, wherein the third support member engages the vertical member and engages the base at a third support member location that is at the same distance from the vertical member as a portion of the second longitudinally extending leg in the lateral direction.

6. An under hood service tray, comprising:

a base;

a vertical member comprising a lower end attached to the base and an upper end with an aperture formed therethrough, the vertical member extending from the base in a vertical direction so that the upper end is distal from the base; and a tray comprising an upper surface, an opposing bottom and a tray bracket that extends from the tray bottom with the tray bracket having a slot formed therethrough, the tray pivotally attached to the vertical member by the tray bracket being fixedly but rotatably secured by a pivot pin that extends through the upper end of the vertical member, the tray is capable of being pivoted from a position where the tray extends over the upper end of the vertical member in which a surface normal directional vector of the upper surface of the tray extends in the vertical direction to a position beside the vertical member in which the surface normal directional vector of the upper surface of the tray extends in a longitudinal direction;

a locking pin that is extendable through the slot of the tray bracket to engage the aperture in the upper end of the vertical member so as to fix the position of the tray in the position where the tray extends over the upper end of the vertical member;

the tray further comprising a first laterally adjustable compartment movable from a closed position to an open position and a second laterally adjustable compartment movable from a closed position to an open position, wherein when a surface normal directional vector of the upper surface of the tray extends in a vertical direction the first laterally adjustable compartment and the second laterally adjustable compartment are movable from their closed positions to their open positions upon movement in a lateral direction away from one another;

a storage basket that engages the base;

a bucket located in the storage basket;

wherein the tray defines an aperture that extends from a bottom of the tray to the upper surface of the tray; and a hose in communication with the aperture and the bucket such that fluid passing through the aperture is transferred through the hose and into the bucket.

7. The under hood service tray as set forth in claim 6, wherein a plurality of open compartments are defined on the upper surface of the tray, wherein slip resistant material is located on the upper surface of the tray, wherein a surface of the first laterally adjustable compartment has the slip resistant material located thereon, and wherein a surface of the second laterally adjustable compartment has the slip resistant material located thereon.

8. The under hood service tray as set forth in claim 6, wherein the vertical member has an outer column that is rigidly attached to the base such that the position of the outer column does not change with respect to the base, wherein the vertical member has an inner column that is received within the outer column and that moves with respect to the outer column in the vertical direction when the vertical member is adjusted in the vertical direction from a low height position to a high height position;

wherein the vertical member has an adjustment mechanism that is capable of being actuated by a user in order to adjust the height of the inner column in the vertical direction;

wherein the tray is pivotally attached to the inner column.

9. An under hood service tray, comprising:

a base;

a vertical member comprising a lower end attached to the base and an upper end with an aperture formed therethrough, the vertical member extending from the base in a vertical direction so that the upper end is distal from the base; and a tray comprising an upper surface, an opposing bottom and a tray bracket that extends from the tray bottom with the tray bracket having a slot formed therethrough, the tray pivotally attached to the vertical member by the tray bracket being fixedly but rotatably secured by a pivot pin that extends through the upper end of the vertical member, the tray is capable of being pivoted from a position where the tray extends over the upper end of the vertical member in which a surface normal directional vector of the upper surface of the tray extends in the vertical direction to a position beside the vertical member in which the surface normal directional vector of the upper surface of the tray extends in a longitudinal direction;

a locking pin that is extendable through the slot of the tray bracket to engage the aperture in the upper end of the vertical member so as to fix the position of the tray in the position where the tray extends over the upper end of the vertical member; and the tray further comprising a first laterally adjustable compartment movable from a closed position to an open position and a second laterally adjustable compartment movable from a closed position to an open position, wherein when a surface normal directional vector of the upper surface of the tray extends in a vertical direction the first laterally adjustable compartment and the second laterally adjustable compartment are movable from their closed positions to their open positions upon movement in a lateral direction away from one another;

wherein the base has a first longitudinally extending leg and a second longitudinally extending leg that are spaced from one another in the lateral direction, wherein the base has a laterally extending leg that extends in the lateral direction and engages the first and second longitudinally extending legs;

wherein the first longitudinally extending leg, the second longitudinally extending leg, and the laterally extending leg define an opening such that a second end of the base opposite a first end of the base is open;

wherein the base has an end leg located on the first end of the base, wherein the first end of the base is closed, wherein the end leg has a first portion that has a component that extends in the lateral direction, and wherein the end leg has a second portion that has a component that extends in the longitudinal direction; and wherein when the tray is in the position such that the surface normal directional vector of the upper surface of the tray extends in a longitudinal direction, the tray is arranged such that the surface normal directional vector extends from the upper surface in the same direction as that of the first end of the base to the second end of the base in the longitudinal direction.

10. The under hood service tray as set forth in claim 6, wherein a plurality of open compartments are defined on the upper surface of the tray, wherein the upper surface of the tray at one of the compartments is located a different elevation in the vertical direction than the upper surface of the tray at a different one of the compartments.

11. The under hood service tray as set forth in claim 6, wherein the tray has a front wall that extends in the lateral direction, wherein the tray has a pair of side walls that extend from the front wall in a longitudinal direction, wherein the tray has a rear wall that extends from one of the side walls to the other one of the side walls, wherein the rear wall has a first portion that has a component that extends in both the longitudinal direction and the lateral direction, wherein the rear wall has a second portion that has a component that extends in both the longitudinal direction and the lateral direction;

wherein the base has a closed first end and an open second end, wherein the first end and the second end are spaced from one another in the longitudinal direction, wherein the direction from the rear wall to the front wall in the longitudinal direction is the same as the direction from the closed first end to the open second end in the longitudinal direction.

* * * * *